US010369401B2

(12) United States Patent
Brown, Jr.

(10) Patent No.: US 10,369,401 B2
(45) Date of Patent: Aug. 6, 2019

(54) APPARATUS AND METHODS OF USING A FLEXIBLE BARBELL FOR ENHANCING THE BENEFITS OF WEIGHTLIFTING

(71) Applicant: Gordon L. Brown, Jr., Anderson, SC (US)

(72) Inventor: Gordon L. Brown, Jr., Anderson, SC (US)

(73) Assignee: Gordon L. Brown, Jr., Anderson, SC (US)

( * ) Notice: Subject to any disclaimer, the term of this patent is extended or adjusted under 35 U.S.C. 154(b) by 135 days.

(21) Appl. No.: 15/683,068

(22) Filed: Aug. 22, 2017

(65) Prior Publication Data

US 2018/0001132 A1 Jan. 4, 2018

Related U.S. Application Data

(62) Division of application No. 14/126,224, filed on Dec. 13, 2013, now Pat. No. 9,925,406.

(51) Int. Cl.
*A63B 21/02* (2006.01)
*A63B 21/06* (2006.01)
(Continued)

(52) U.S. Cl.
CPC ..... *A63B 21/0724* (2013.01); *A63B 21/026* (2013.01); *A63B 21/027* (2013.01); *A63B 21/0728* (2013.01); *A63B 21/0603* (2013.01); *A63B 21/0604* (2013.01); *A63B 2022/0092* (2013.01); *A63B 2023/0411* (2013.01); *A63B 2071/0694* (2013.01); *A63B 2209/02* (2013.01); *A63B 2209/10* (2013.01); *A63B 2220/62* (2013.01)

(58) Field of Classification Search
CPC ..... A63B 21/0724; A63B 21/027; A63B 21/0728; A63B 21/026; A63B 2023/0411; A63B 2071/0694; A63B 2220/62; A63B 2022/0092; A63B 2209/10; A63B 21/0604; A63B 21/0603; A63B 2209/02
See application file for complete search history.

(56) References Cited

U.S. PATENT DOCUMENTS 405,128 A 6/1889 Stockburger
4,690,399 A * 9/1987 Hayashi ..... A63B 21/075 482/108

(Continued)

FOREIGN PATENT DOCUMENTS

DE 101 25 215 A1 1/2003
KR 890 000 870 4/1989

OTHER PUBLICATIONS

Extended European Search Report for EP Application No. 12802021.1; EPO; dated Dec. 22, 2014.

*Primary Examiner* — Andrew S Lo
(74) *Attorney, Agent, or Firm* — Joseph T. Guy; Patent Filing Specialist, Inc.

(57) ABSTRACT

A system, and method, for training athletes to increase power is provided in a flexible barbell for enhancing weight lifting exercises. The flexible barbell has an elongated shape comprising ends. At least one flexible bar may be included when an elongated shape with a center is used. Weights are attached to the shape near the ends. The shape bends relative to a tangent to the center in response to the center of the flexible barbell being moved.

53 Claims, 5 Drawing Sheets

(51) Int. Cl.

| | |
|---|---|
| ***A63B 22/00*** | (2006.01) |
| ***A63B 21/072*** | (2006.01) |
| *A63B 23/04* | (2006.01) |
| *A63B 71/06* | (2006.01) |

(56) References Cited

U.S. PATENT DOCUMENTS 4,828,256 A * 5/1989 Lee ..... A63B 21/0724 482/106
4,921,246 A * 5/1990 Hornbostel ..... A63B 21/0724 482/106
4,964,633 A * 10/1990 Hymanson ..... A63B 21/027 482/110
5,147,262 A * 9/1992 Hymanson ..... A63B 21/027 482/110
5,190,510 A * 3/1993 Goodger ..... A63B 21/00181 482/104
5,393,284 A * 2/1995 Wesley ..... A63B 21/0602 482/106
5,891,003 A * 4/1999 Deac ..... A63B 5/16 482/106
6,872,174 B2 * 3/2005 Benach ..... A63B 21/00043 482/121
7,491,156 B1 * 2/2009 GaoYong ..... A63B 21/0724 482/106
7,722,510 B2 * 5/2010 Jhu ..... A63B 21/0004 482/106
7,951,051 B1 * 5/2011 Brown ..... A63B 21/0004 482/111
8,038,585 B1 * 10/2011 Brown, Jr. ..... A63B 21/0004 482/108
2004/0082449 A1 * 4/2004 Brown, Jr. ..... A63B 21/026 482/140
2005/0079962 A1 * 4/2005 Brown, Jr. ..... A63B 21/026 482/121
2007/0135275 A1 * 6/2007 Oates ..... A63B 21/0004 482/109
2007/0197352 A1 * 8/2007 Charniga ..... A63B 21/06 482/93
2008/0287272 A1 * 11/2008 Luckadue ..... A63B 21/027 482/107
2013/0196830 A1 * 8/2013 Pfitzer ..... A63B 21/0602 482/110

* cited by examiner

APPARATUS AND METHODS OF USING A FLEXIBLE BARBELL FOR ENHANCING THE BENEFITS OF WEIGHTLIFTING

CROSS-REFERENCE TO RELATED APPLICATIONS

This application is a divisional application of pending U.S. patent application Ser. No. 14/126,224 filed Dec. 13, 2013 which, in turn, is a National Stage Entry Application of expired PCT/US2012/042627 filed Jun. 15, 2012 which, in turn, claims priority to U.S. Provisional Patent Application No. 61/632,027 filed Jan. 17, 2012 and to U.S. Provisional Patent Application No. 61/571,054 filed Jun. 20, 2011 all of which are incorporated herein by reference.

FIELD OF INVENTION

The instant invention is related to a flexible barbell which can be grasped by at least one hand and designed to be used by weightlifters to enhance conditioning. More specifically, the present invention is related to an elongated flexible barbell, and a method of use, which increases muscular power.

Power is the maximum amount of work that can be performed in the minimal amount of time. It is somewhat based on strength but has elements of speed of motion. Power is the foundation of athletic performance in most sports.

Traditional barbells, which are relatively rigid, are well known and widely used to train athletes. Certain exercises are performed which are designed to increase the strength of the athlete. While effective at increasing strength, traditional barbells are not effective at increasing power. An experienced lifter can easily make every repetition look identical to the last and they are trained to accomplish consistency in their training. Lifting a traditional barbell involves lifting "dead weight". The traditional bar has very little flex and once a lifter finds "the groove" on any particular lift the traditional bar can be moved in a very predictable manner. Unfortunately, this does not always translate well into sport performance, especially in contact sports, where a dead weight does not effectively mimic action.

Vladimir Zatsiorsky, in his book "Science and Practice of Strength Training", identifies a phenomenon called "Explosive Strength Deficit (ESD)" which can limit an athlete's ability to generate power despite his or her ability to generate absolute strength. The reason for this is that there is a relationship between strength and time. Maximum strength (force development) takes more time than most sport performances allow. The window of opportunity to generate force during real sport performance is small. For example, the length of time a sprinter's foot is in contact with the ground during a race is very short and it is during this short time that maximum strength needs to be applied. Similarly, a batter must move a bat from near rest to full speed quickly to achieve maximum strength at the point in time when the bat impacts the ball. During many sport performance events there is insufficient time to generate maximum strength within the time allowed to exert maximum force or power.

There has been a long standing desire to convert the potential for generating force (otherwise known as strength) and train our bodies to generate as much of that force or power as possible. There has also been a long standing desire to reduce explosive strength deficit of athletes by being able to generate the greatest portion of absolute strength within the time limits of a particular sport performance. To accomplish this the neuromuscular system must be trained, which means applying resistance in a very sport specific manner that allows the athlete to mirror the speed of movement as much as possible. Many training systems are designed to do this such as plyometric training, weighted implements and through the use of lifting submaximal weights very rapidly. These methods have their limitations. Lifting weights rapidly or using weighted implements often requires deceleration at the end of the motion which does not often carry over to the sport performance. Plyometrics often use body weight and are therefore limited by this as a resistance exercise. Adding weight to the body using weighted vests can circumvent this problem, but increases the risk of injury to the athlete.

The present invention greatly enhances the training regimen of athletes by converting strength of the muscles to power by neuromuscular training.

BRIEF SUMMARY

It is an object of the invention to provide an improved system, and method, for training the neuromuscular system of athletes to enhance sports performance.

It is another object to provide a system, and method, for training athletes to increase power.

These and other embodiments, as will be realized, are provided in a flexible barbell for enhancing weight lifting exercises. The flexible barbell has an elongated shape comprising ends and capable of being grasped by at least one hand. Weights are attached to the shape near the ends. The shape bends relative to a tangent to the center in response to the center of the flexible barbell being moved.

Yet another embodiment is provided in a speed training method of exercise comprising:

providing a flexible barbell wherein the flexible barbell has an elongated tube with a center and ends, at least one flexible bar or rod in the tube, weights attached to the tube near said ends and wherein the tube bends relative to a tangent to the center in response to the center being moved;

grasping the flexible barbell between the ends;

moving the flexible barbell in a first direction at a rate sufficient to cause the flexible barbell to have a momentum towards the first direction; and moving the flexible barbell in a second direction away from the first direction while the momentum continues towards the first direction.

Yet another embodiment is provided in a force training method comprising:

providing a flexible barbell with an elongated shape having a center and ends, at least one flexible bar or rod in the tube and weights attached to the shape wherein the shape bends relative to a tangent to the center in response to the center being moved;

grasping the flexible barbell;

executing an eccentric phase of muscle contraction;

pausing while the weights move towards an approximate end of a first oscillation movement; executing a concentric phase of muscle extension as the weights reach the approximate end of the first oscillation movement;

pausing while the weights move towards an approximate end of a second oscillation movement; and repeating the eccentric phase of muscle contraction as the weights reach the approximate end of the second oscillation movement.

DESCRIPTION

The instant invention is related to a flexible barbell which can be grasped by at least one hand and designed to be used by weightlifters building muscular force strength, muscular velocity strength, muscular endurance strength, increase the speed of muscle contraction, enhance the ability of the various supporting muscles, ligaments and tendons to work together more effectively and to train the sensory receptors (proprioceptors) in the muscles and tendons to improve the ability of the individual to be more aware of the relative position of the various muscle groups which interact in performing a movement thereby resulting in an enhanced ability to perform movements more effectively.

The invention will be described with reference to the various figures which are included for the purposes of describing the invention without limit thereto. Throughout the invention similar elements will be numbered accordingly.

Figure 1:
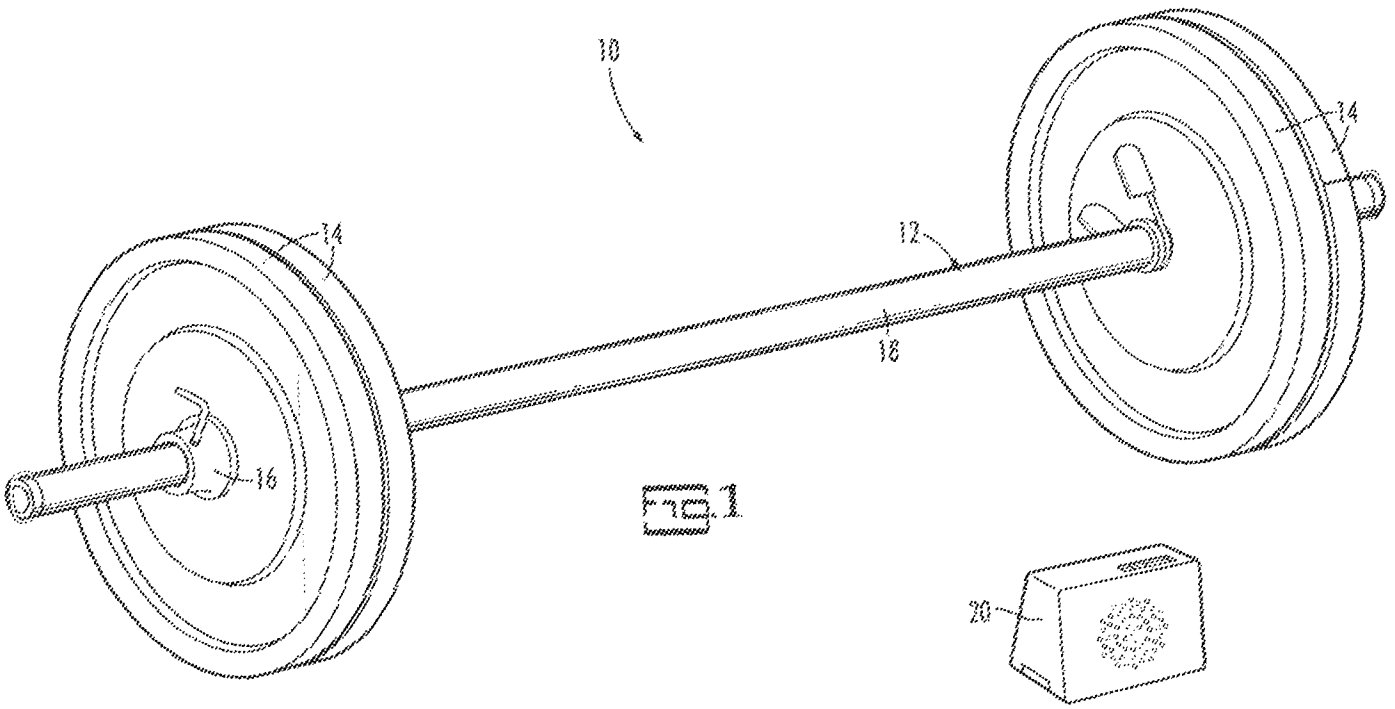
FIG. 1 is a schematic representation of an embodiment of the invention.

An embodiment of the invention will be described with reference to FIG. 1. In FIG. 1 a system for neuromuscular training is illustrated in schematic view. A flexible barbell system, generally represented at 10, is illustrated with weights, 14, thereon. A safety collar, 16, is preferably provided to prohibit weights from sliding off of the flexible barbell during use. The flexible barbell, 12, preferably comprises a surface treatment, 18, which will be described in more detail herein. A timing device, 20, is preferred to assist the athlete in the timing of the lifting exercise to insure that the movement of the flexible barbell during a lift is in concert with the flexing of the flexible barbell as will be more fully described herein. The timing device may be a metronome or any device which can alert to a preset repeating pattern of time intervals.

Figure 2:
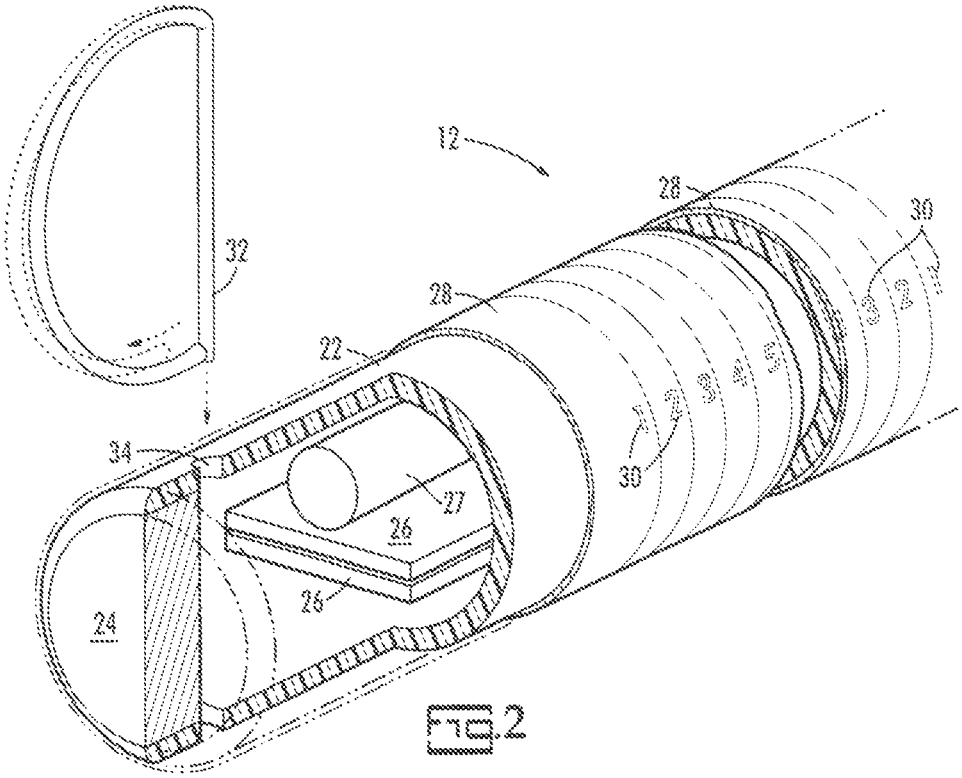
FIG. 2 is a partial cross-sectional schematic representation of an embodiment of the invention.

An embodiment of the invention will be described with reference to FIG. 2. In FIG. 2 a flexible barbell, 12, is illustrated in partial cross-sectional view. The flexible barbell comprises an elongated shape, 22, such as a tube which is sealed on either end by a closure such as an end cap or end plug, 24. The closure prohibits flexible bars, 26, or flexible rods, 27, inside the elongated shape from exiting the elongated shape. At least a portion of the elongated shape is preferably covered with a surface treatment, 28, which may be an applied coating or a wrap. An applied coating is a material which is applied as a flowing chemical such as by a dip, spray or spread-on material and a wrap is a material which is adhesively applied. The surface treatment is preferred to improve the grip, aesthetics, durability, stiffness or friction of the exterior of the elongated shape. Indicia, 30, along the elongated shape are preferred. The indicia allow the separation of the weights or the separation of the hands to be placed at a specific distance repeatedly and accurately and insure the center of the flexible barbell is indicated to avoid lateral weight asymmetry. A hitch pin, 32, which is received by a void, 34, insures that the weights do not slide off of the ends of the flexible barbell. A safety collar, as well known in the art, may be used independent of or in addition to a hitch pin.

Figure 3:
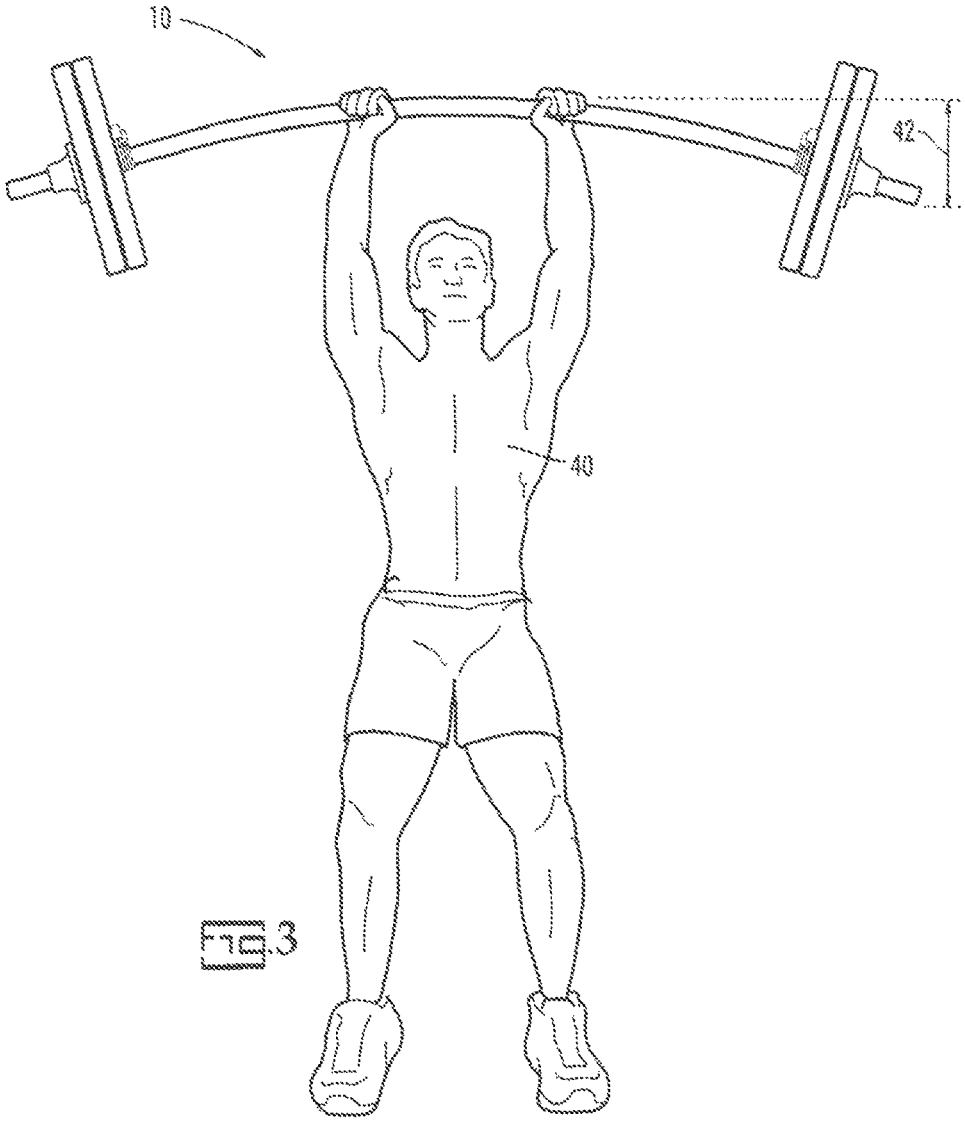
FIG. 3 is a schematic representation of an embodiment of the invention.
Figure 5:
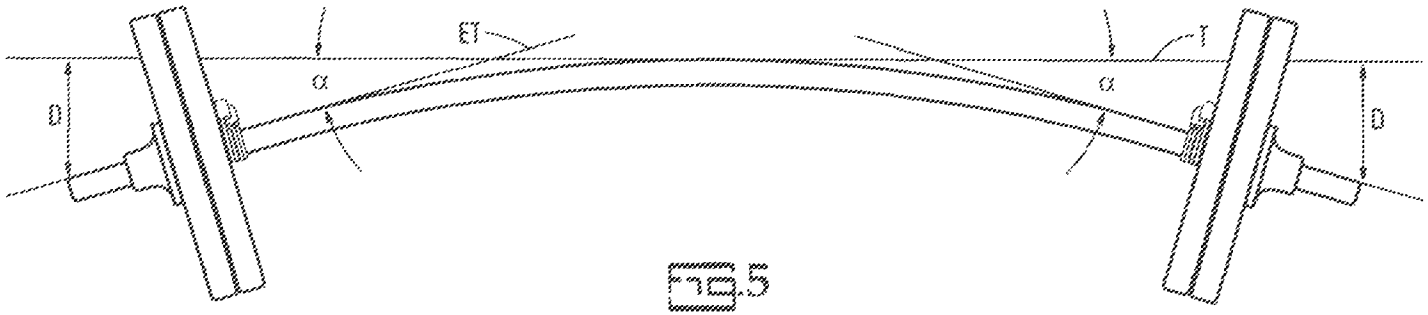
FIG. 5 is a diagrammatic representation of an embodiment of the invention.

An embodiment of the invention will be described with reference to FIG. 3. In FIG. 3 a lifter, 40, is illustrated fully extended. The flexible barbell, 10, with weights, 14, is shown bent from linearity. The deviation from linearity will be described with reference to FIG. 5. In FIG. 5, a tangent to the center, T, is defined at the center of the flexible barbell. The deviation is measured as the distance the end of the bar is from the tangent, indicated as D. Alternatively, the deviation can be measured as the acute angle $\alpha$, between the tangent to the center, T, and an end tangent ET at the weights. It would be realized that the deviation can be measured in any plane. It is preferred that the static deviation from linearity, D, is at least 2.5 inches to no more than about a 45 degree acute angle $\alpha$.

In a particularly preferred embodiment the movement rate for a single back and forth motion is 1-5 ft./second and as the lifter reverses direction the momentum of the weight is moving in the opposite direction. If the deviation from linearity is less than about 2.5 inches the flexibility of the flexible barbell is insufficient to move in response to the lift. If the static deviation from linearity is more than about a 45 degree acute angle $\alpha$ the flexible barbell will probably deflect too much during use.

Figure 4B:
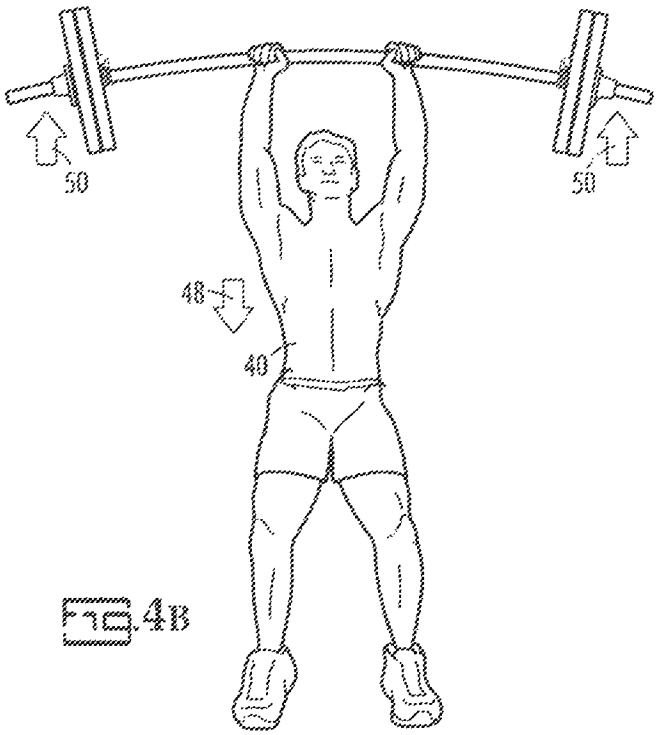
FIGS. 4A and 4B are schematic representations of an embodiment of the invention.
Figure 4A:
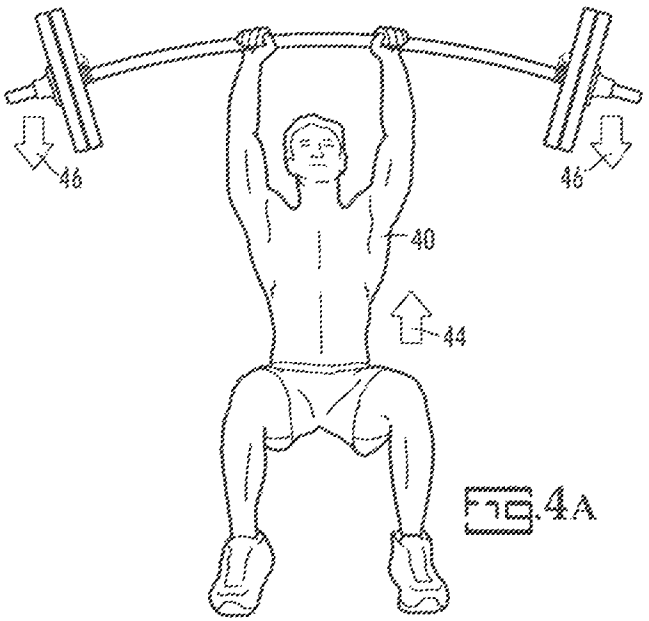

An embodiment of the invention will be described with reference to FIGS. 4A and 4B. In FIGS. 4A and 4B the lifter, 40, is moving from a squatted position to a standing position in the direction of arrow 44 while the initial force of the weights is in the direction of arrows 46. The lifting motion is referred to in the art as the concentric phase. As the lifter reaches the full extension and reverses direction as indicated by arrow 48 the momentum of the weights is in the direction of arrows 50. The lowering motion is referred to in the art as the eccentric phase. To optimize the results the momentum is contrary to the movement of the lifter each time the direction of movement changes. As would be realized from further discussions herein the oscillatory amplitude of the flexible barbell is higher than the oscillatory amplitude of the lifter. In one embodiment the lifter will pause for a time to allow the weights to approach the end of their oscillatory cycle, represented by D in FIG. 5, prior to reversing direction.

In use, the flexible bars and rods in the elongated shape provide strength to the flexible barbell and are chosen to achieve the proper amount of flexibility for the weight range and exercise of choice as more fully described herein. Bars with a rectangular cross-section are most preferred but rods find use both with and without bars where increase in bending stiffness is required. Flexible rectangular bars rotate within the elongated shape such that the largest face of the rectangle is perpendicular to the direction of force applied to the flexible barbell.

The form of the weights used with the instant invention is not particularly limited. Olympic style and standard disc weights, weighted bags such as sand filled bags, chains and/or other weighted devices affixed to each end of the flexible barbell can be used. The weight may be in the form of disc weights where the flexible barbell is inserted through a hole in the center of the disc weights, bags filled with weighted materials such as sand and secured to the ends of the flexible barbell using straps or any other weighted form that can be attached to the ends of the flexible barbell. Iron plates or discs, are widely used with weight lifting. The plates typically range in weight from about 2.5 lbs to about 100 lbs. Plates typically have a centrally located hole. Plates with a hole having an approximate diameter of 2" are typically referred to as Olympic disc weights and plates with holes having an approximate diameter of 1" are typically referred to a standard disc weights. Sand bags, such as those available from Rae Crowther Co. of Rock Hill, S.C. are filled with sand and typically weight from about 35 lbs to about 55 lbs. Kettlebells typically range from about 20 lbs to about 80 lbs. Kettlebells feature an approximate round steel ball with integral curved handle allowing the kettlebell to be grasped by one or both hands. Kettlebells may be suspended from the flexible barbell by sliding the handle onto an end of the flexible barbell and securing the kettlebell to the flexible barbell by a mechanical means such as a spring clamp, Velcro® straps, etc. or the kettlebell can be suspended from the flexible barbell using a device such as a chain which is wrapped around the flexible barbell, hook lock or other type of device that would be either permanently affixed to the flexible barbell or temporarily affixed to flexible barbell such as a Velcro® strap or hook lock. Metal chains may be suspended from each end of the flexible barbell by a hook. Chains and hooks are available from 'TOTAL STRENGTH AND SPEED, Inc.' of West Columbia, S.C.

The flexible barbell bends up and down at its ends in response to the up and down movements of the body using traditional weightlifting movements. One such weightlifting movement is a back squat wherein the center of the flexible barbell is positioned behind the user's neck which allows the user to condition and train the affected muscles in a beneficial way and in ways that are not possible when using traditional steel barbells where the degree of bend during use is minimal due to the very rigid material's properties of steel. The effects of traditional weightlifting movements is further enhanced when the user moves their body or parts of their body such as their arms, shoulders, or legs in a up and down or back and forth manner which allows the ends of the flexible barbell to move or oscillate in an up and down or back and forth manner in trailing rhythm to the movements of the user's body and in response to the forces transmitted to the flexible barbell by the user as the exercise movement is performed. This oscillatory movement of the ends of the flexible barbell causes stresses (or forces) to be transmitted to the user's muscles, tendons and joints plus conditioning and training of the sensory receptors in the user's muscles, tendons and joints such that beneficial results occur for the user. Some of the beneficial results are the ability of the muscles to contract faster which allows for greater speed of movement which can give the user greater power in the use of their body with particular emphasis on the use of the arms, shoulders, legs and core.

The oscillating movement of the ends of the flexible barbell allows the user to perform isokinetic oscillatory exercise as a result of the ends of the flexible barbell moving up and down or back and forth depending on the methods that the user will be practicing for strengthening and conditioning of the user's muscles, tendons and joints. Further, the timing and efficiency of the concentric and eccentric muscle contractions in body parts performing the exercise will be enhanced through proper practice of the methods of use of the flexible barbell. In addition, when placing the flexible barbell behind the neck, such as in performing a back squat, the loads of the flexible barbell are transferred in a safer manner to the outer sections of the body in the shoulder area and over the hips and legs as opposed to being transmitted along the length of the spine in the center of the body as occurs with the use of a rigid steel barbell. This present invention will define several methods of using the flexible barbell in performing exercises that will be beneficial for the user and will be readily understood by professionals in the Strength and Conditioning field.

The methods of exercise are dependent upon the proper flexibility and strength characteristics of the flexible barbell in combination with the placement on the flexible barbell of the selected disc weights or other weight forms to allow the user to develop a rhythmic movement that is in harmony with the up and down or back and forth movement of the ends of the flexible barbell in response to the forces imparted to the center section of the flexible barbell by the movement(s) of the user. An apparatus construction that allows the ends of the flexible barbell, with weights affixed, to oscillate with appropriate oscillation amplitude and oscillation frequency to permit effective use of the flexible barbell by the weightlifter is desired herein. U.S. Pat. No. 7,951,051 entitled Variable Resistant Exercise Device is incorporated herein by reference.

The stiffness of a shape constructed of a particular material is defined as:

$$\text{Stiffness}=E*I$$

wherein E is the flexural modulus of the material and I is the moment of inertia of the shape geometry.

In addition to the stiffness of the flexible barbell, the oscillation frequency and oscillation amplitude are influenced by multiple factors. For a composite, the type of fiber used as the reinforcement in the flexible bar is a factor with oscillating frequency and oscillation amplitude with glass fibers being the preferred fiber. The diameter of the flexible barbell is a factor in oscillating frequency and oscillation amplitude with a diameter from 1" to about 2.5" being the preferred range. The method of obtaining the required flexural strength is a factor in oscillating frequency and oscillation amplitude with the use of fiber reinforced composite shapes in combination with an extruded thermoplastic tube being the preferred materials. The length of the flexible barbell is a factor in oscillating frequency and oscillation amplitude with a length from 5 to 8 feet being the preferred range. The use of functional closures on the ends of the flexible barbell to insure safe and efficient use of the flexible barbell influences oscillating frequency and oscillation amplitude to a lesser degree.

The model also describes the dual action of the flexible barbell, which adds an element of stabilization. Unlike conventional stabilizer exercises like the Swiss ball, in which the training surface is unstable, the flexible barbell provides an unstable resistance or "live weight". But, the flexible barbell does more than target stabilizer muscle groups. It allows the lifter to generate maximal forces with submaximal weights loaded on the flexible barbell.

The flexible barbell generates forces based on two primary factors. One factor is flexible barbell frequency, which is based on the flexibility of the flexible barbell, the length of the flexible barbell, where the weights are placed on the flexible barbell and the amount of weight being used. The flexibility of the flexible barbell is constant and cannot be manipulated by the lifter. However, the other three variables can be manipulated. Another factor is user frequency, or force frequency, which is based on hand placement and the timing of the repetition frequency or how fast or slow the lifter moves the flexible barbell.

Each hand is preferably positioned on each side of the centerline of the flexible barbell at a distance from 8" to 24" with 8.5" to 9.5" being the most common position for the hands from the flexible barbell's centerline.

With the flexible barbell the forces generated by the flexible barbell, known as impulse forces, can be affected by the timing of the lift. Impulse forces are defined as how much force is needed to change the direction of the flexible barbell as it moves downward, in a given amount of time. Putting this into a simple formula:

Force $X$ Time(impulse force)=Mass $X$ change in velocity

In the flexible barbell lifting protocol this can be manipulated by setting the metronome at very specific lifting frequencies to fit the training goal. Decreasing the "time" factor in the above equation requires an increase in "force", thus by increasing the frequency of the metronome we can increase the amount of force needed to move the weight. We can control the amount of force by either speeding up the repetition frequency or slowing it down without ever having to change the weight on the flexible barbell. The stiffness (EI) of the flexible barbell with E=the elastic characteristics of the material used to construct the shapes used in the flexible barbell and I=the moment of inertia of the shapes used to construct the flexible barbell remains relatively constant under differing parameters such as changing the weight on each end of the flexible barbell.

The flexible barbell allows for minimal joint stress since the force needed to move the weight changes throughout the range of motion and is only maximal at predetermined points throughout the lift. The flexible barbell and a standard barbell have been compared using electromyography (EMG) to compare muscle activation in various lifts. These tests lead to the conclusions that the stabilizer muscles are 3 times more active using the flexible barbell properly in the bench press. The pectoral muscles and deltoid muscle groups were found to have a much greater EMG response in the deltoid groups. During a close grip bench press, in which the lifter stops the flexible barbell four inches from the chest and immediately presses the weight upward while the flexible barbell is still accelerating downward, the muscle activation was 20% greater than the same action using a standard barbell of the same weight. In other words, the muscle activation at the transition from down to up was much greater using the flexible barbell. Proper training is critical since the flexible barbell does all the work if the timing is not right.

Power, speed and agility can be improved using the flexible barbell. Many training systems use chains or rubber bands to increase resistance through the range of motion of many standard barbell lifts such as bench press and squats. The drawback of this method is that the weight decelerates from start to finish as the resistance increases. Deceleration is not representative of actual activities such as jumping, sprinting or throwing where follow through is critical to performance. The wave action of the flexible barbell maximizes force at a predetermined critical phase of the lift, but then decreases force to allow the athlete to accelerate.

Most lifts performed on a standard barbell can be adapted using the flexible barbell. However, to get the most out of the flexible barbell, it is not simply a matter of using it the same way as you would a standard barbell. An ideal system would allow for resistance to increase meeting the most critical phase of a given movement and then decrease to allow for full acceleration on the follow through. When used properly the flexible barbell does just that.

The flexible barbell employs two types of oscillations simultaneously. The lifter must time exertion based on the target adaptation which is dictated by the sport performance one is trying to train. As an example, in jumping there is a critical point in the range of motion in which maximum ground reaction forces must be generated to get maximum height. That point where the hips and knees are flexed and are about to extend explosively upward. The flexible barbell allows an athlete to initiate the jump as the flexible barbell is accelerating downward to hit that critical "sweet spot" in the jumping motion. The faster the flexible barbell accelerates downward, the greater the resistive forces at that point. But unlike conventional weights, once the maximal resistance is met, the momentum of the flexible barbell transitions to an upward acceleration allowing the athlete to move more rapidly on the follow through of the jump. Thus maximal resistance only occurs where it is needed.

The invention is not intended to be limited to the embodiments described; rather, this detailed description is included to enable any person skilled in the art to produce and to use effectively a flexible barbell such that the ends of the flexible barbell will bend in the downward direction when weighted devices are attached to each end of the flexible barbell and the flexible barbell is supported in the center section of the flexible barbell by a means such as the supporting brackets on a steel lifting frame or behind the neck and on the shoulders of a lifter which act on the center section of the bar to allow gravity to pull the ends of the flexible barbell in the downward direction. And the flexible barbell responds to forces that are applied to the center section of the flexible barbell with the weighted devices on the outside of the applied forces such that as the forces are applied in an up-and-down manner (as in a bench press starting with the flexible barbell on one's chest) or a down-and-up manner (as in a squat with the flexible barbell behind one's neck and the person starting from a standing position) or a forward-and-back manner (as in a Zercher Push Pull movement), by oscillation of the ends of the flexible barbell with the amplitude of oscillation of the ends of the flexible barbell proportional to the magnitude and speed and duration of the force applied to the center section of the flexible barbell with the person that is exerting the force in the center section of the flexible barbell controlling the oscillation amplitude of the ends of the flexible barbell by the timing of their application of force to the center section of the flexible barbell as the ends of the flexible barbell are oscillating up-and-down, by the force and speed that is exerted on the center section of the flexible barbell and any delays that the individual may insert into the movement or lifting routine to allow the oscillating ends of the flexible barbell to reach a different position before resuming the application of a force at a given speed to the center section of the flexible barbell.

A traditional steel barbell is very stiff and does not bend (nor is a steel barbell designed to bend) appreciably in performing the wide variety of exercises such as those using a flexible barbell with weights on each end such as bicep curls, military presses, barbell upright row, bench presses, barbell squats, deadlifts, or clean and jerks. When significant weights are placed on a steel barbell, the ends of the barbell will deflect downward slightly but a rhythmic oscillation of the ends of a steel barbell during use does not occur when using steel barbells in use today due to the stiffness of the steel barbells in use today. Traditional steel barbells are either approximately 7 feet or 8 feet in length although other lengths can be used. It has not been demonstrated to date to use a traditional steel barbell to produce a beneficial up and down oscillatory type of movement as can be performed with a flexible barbell as described in the various preferred embodiments of the present invention which have been constructed to give the strength and stiffness of the flexible barbell necessary to allow acceptable oscillatory amplitude and oscillatory frequency in conjunction with the movements of the user in performing the many weightlifting exercises using a flexible barbell with circular weights placed at each end of the flexible barbell. The person performing the exercises can position their hands so that one hand in on top of the other hand in the center of the flexible barbell, the two hands are side by side with the 2 thumbs or 2 index fingers touching in the center of the flexible barbell or with the hands spaced an equal distance apart from the center of the flexible barbell or using just one hand which is placed at the approximate center of the device. The flexible barbell can be positioned behind the neck and supported at the shoulder areas, in the cusp of the arms as in performing a Zercher push-pull or in other ways where the ends of the flexible barbell are able to respond to forces exerted on the center of the flexible barbell to produce acceptable oscillation amplitudes and oscillation frequencies for the weight-lifting method practiced. This invention and methods of using the invention pertain to a flexible barbell and is hereinafter described in detail.

The flexible barbell allows the user to train and condition their muscles in more effective ways than using a traditional steel barbell which is very stiff. The lifting phase of an exercise movement is called the concentric phase. The lowering phase of an exercise movement is called the eccentric phase. A person can generally 'lower' about 40% more weight than they can 'lift'. In the lifting phase of an exercise using a flexible barbell, the actual amount of weight that is felt by the person when starting the exercise movement, such as a deadlift, is less with a flexible barbell than with a steel barbell due to the fact that the flexible barbell bends in the center as the individual applies the initial upward force to the center of the flexible barbell with the weights outside the hand position towards the ends of the flexible barbell. Once the flexible barbell has bent to the point where the stiffness of the flexible barbell is sufficient to raise the weights off of the surface, then the full weight of the flexible barbell with weights will be transferred to the muscles of the user, but in a different and potentially more beneficial manner than with using a traditional steel bar. There is a lag or delay in the transfer of the full weight of the flexible barbell and weights to the user because the center portion of the flexible barbell bends first with less force required by the user until the ends of the flexible barbell have moved off of the surface and upward once the flexible barbell's strength and stiffness is able to overcome the downward weight of the circular weights at each end of the flexible barbell. The invention is not intended to be limited to the embodiments described; rather, this detailed description is included to enable any person skilled in the art to construct a flexible barbell and to perform weightlifting exercises following methods that will allow the movements of the user to interact with the responses of the flexible barbell to enable the exercises to be done in a beneficial manner.

The flexible barbell is made from special composite materials, which provides a unique training stimulus. The motion of the flexible barbell has been scientifically analyzed using high speed cameras and a computerized motion analysis. The data from this analysis was then used to develop a precise mathematical modeling of the motion of the flexible barbell. The mathematical model provides great insight into the forces generated when the flexible barbell is used in the proper fashion, depending on the lift performed. All standard Olympic lifts can be performed using the flexible barbell.

The elongated shape of the flexible barbell may have any suitable shape with a round or approximately round exterior to include an oval shape with many types of materials inserted to the center cavity of the device if the shape has a center cavity or materials placed or applied on or onto the outside of the device that makes contact with the person's hands as long as the shape exhibits that capability to flex adequately such that that shape does not crack, crimp or break in performing the various lifting procedures and the shape exhibits acceptable oscillation amplitude and oscillation frequency characteristics in performing at least one of the many lifting procedures used in the strength and conditioning of individuals.

The flexible barbell preferably has an approximately hollow round shape with a uniform wall thickness formed by the process of fixed length or continuous filament winding over a mandrel such as a round steel mandrel in which continuous fibers of glass, carbon, aramid, nylon or combinations of these are saturated with a liquid resin are wound around the mandrel at angles from the horizontal that can vary from zero degrees to 90 degree (i.e. 45 degrees, 75 degrees, etc.) with the normal practice being that the wind angles are balanced with an example being a balanced winding of fibers in a +/−45 degree from horizontal, or angles of wind that features more than one wind angle such as a combination of an approximately zero degree wind angle fibers for one or more layers with one or more layers of an approximately 90 degree wind angle, or a combination of wind angles such as +/−10 degrees combined with +/−75 degrees. The reason for multiple wind angles is to provide acceptable combination of hoop strength with longitudinal strength with the longitudinal component being the primary contributor of bending stiffness which affects the flexibility and the oscillation (frequency and amplitude of oscillation) characteristics of the flexible barbell. Use of a thermoset resin is preferred in filament winding products although a thermoplastic resin may be used.

Particularly preferred materials for the tube are polyvinyl chloride (PVC), polypropylene (PP), high density polyethylene (HDPE) and chlorinated polyvinyl chloride (CPVC).

The flexural modulus of the fiber reinforced resin shape can be measured using traditional testing methods. Below is an example of two (2) filament wound products that are manufactured on a continuous process with the benefit of a continuous process being that the mandrel can be a constant and consistent diameter the entire length of the filament wound part. This constant diameter along the length of a flexible barbell is desirable in that this insures that the bending characteristics on each side of the centerline of the flexible barbell are the same and that the disc weights used in the weighting industry will fit uniformly on each end of the flexible barbell.

Representative elongated shapes s include a fiberglass pipe with OD from about 1" to 2" with continuous strands of glass fiber in both the longitudinal direction, up to 15 degrees off of zero degrees direction, and hoop directional with angle of wound continuous strands of glass being between 90 degrees and 45 degrees from the longitudinal or zero degree direction provided by Ameron-Bonstrand of Burkburnett, Tex. as Series 2000 Fiberglass Pipe, product code FP163F. This tubular product is not tapered and has a consistent 2" nominal OD, 1.67" ID and consistent wall thickness.

Another representative elongated shape is provided by Glasforms, Inc. of San Jose, Calif. which is an epoxy resin tubing primarily for use with 'Standard Weight Disc Plates'. The elongated shape is a filament wound epoxy resin tubing using continuous glass fibers as the reinforcement. The following products can be used for flexible bars using weights with a 'hole' with diameter of about 1". Model BW106500 has nominal 1.065" OD, 0.872" ID a wall thickness of 0.093" and is available in a length of 108".

Model BW106510 has nominal 1.065" OD, 0.872" ID a wall thickness of 0.093" and is available in a length of 79". Module BW106520 has a nominal 1.065" OD, 0.872" ID a wall thickness of 0.093" and is available in a length of 59.75". A particularly suitable elongated shape for demonstration of the invention is a 94⅜" PVC schedule 40 extruded pipe manufactured by Silver-Line® Plastics Asheville, N.C. 28804 which has an approximate OD of 1.91 inches and an ID of 1 9/16"; a 1" CPVC extruded pipe, 100 psi rated, manufactured by Silver-Line® Plastics Ashville, N.C. 28804 which has an inside diameter of approximately ⅞" and an OD of approximately 1⅛" with lengths of 91⅞" or 92 3/16".

Particularly preferred elongated shapes feature the use of continuous glass or carbon fibers with defined layers of the continuous fibers being either in the longitudinal direction, zero degrees to the lengthwise direction, or hoop direction, approximate 90 degrees to the lengthwise direction with this angle capable of going down to 45 degrees.

Particularly preferred elongated shapes have an approximately hollow round shape with a uniform wall thickness and constant cross-section formed by the process of pultrusion in which continuous forms of reinforcing materials such as continuous fibers, glass, carbon, aramid, nylon, etc., continuous rolls of reinforcing mats or fabrics plus continuous rolls of materials such as surfacing veils of nylon or polyester fiber are wetted with a liquid thermoset or thermoplastic resin with the resulting wetted material system pulled through a shaping device and then into a curing die where the final shape of the end product is fixed either by cross-linking of the thermoset resin or cooling of the thermoplastic resin with the thermoplastic resin having been heated to a liquid state or a room temperature thermoplastic resin is used such a PVC plastisol. In some pultrusion processes the liquid resin is injected directly into the curing die to wet the reinforcements. The amount and orientation of the reinforcing materials is selected to give acceptable stiffness of the shape to be able to exhibit acceptable oscillatory frequency and oscillatory amplitude to function as a flexible barbell. The pultruded products are continuously pulled over a fixed mandrel and through a die which insures a fixed and consistent OD making pultruded round elongated shapes ideally suited as candidates for a flexible barbell with the selection of the appropriate reinforcing materials determining the elongated shape's flexibility and the oscillation frequency and amplitude which can be designed into the pultruded product to match the performance characteristics of the identified preferred embodiments. The focus of the pultruded flexible shapes will be the round elongated shapes with an OD of both 2" and 1" making them useable with existing disc weight which have an ID of either 2" or 1". A pultruded shape using a vinyl ester resin is preferred to insure the best long term flexural performance. Acceptable pultruded tubing can be purchased from Strongwell Corporation of Bristol, Va.

An approximately hollow round shape with a uniform wall thickness and constant cross-section formed by the process of extrusion augmented with pultrusion in which continuous forms of reinforcing materials such as continuous fibers (glass, carbon, aramid, nylon, etc.) are wetted with a liquid resin (a liquid PVC thermoplastic plastisol) with the resulting wetted materials or B-stage materials pulled into an extrusion machine in advance of the extrusion die with curing of wetted reinforcements and consolidation of the wetted reinforcement(s) with the melted PVC pellets occurring in the heated extrusion die chamber. An alternate method is to feed a fully or partially cured reinforced strand(s) into the extrusion dies chamber such that that the resin impregnated reinforcing strand(s) is surrounded by the melted thermoplastic resin. If the resin component of the reinforced strand is a PVC plastisol, then a degree of chemical bonding will occur and if the resin matrix is another resin such as a thermoset resin then the degree of chemical bonding will be less and primary bonding will be either mechanical and/or simple sticking of the thermoplastic extrusion resin to the surface of the fiber reinforced strand. In either of these methods the primary fiber direction is parallel to the lengthwise direction of the extruded round shape. Where the extrusion thermoplastic pellets are PVC and the resin used to wet the reinforcements is a PVC plastisol with the resulting shape cured in a heated die reference hereby is made to U.S. Pat. No. 6,955,735B2 issued Oct. 18, 2005.

The internal flexible bar can be a solid round shape with a constant OD or solid shape with a major and a minor axis with the two axis not of the same dimension made from such materials as composites which contain continuous reinforcing fibers and a suitable resin using the process of pultrusion, or a metallic shape made from a material like steel, spring steel, aluminum, etc. which has appropriate stiffness, flexibility and adequate flexural fatigue performance may be used as the primary material of construction or as a component of the construction of a flexible barbell and even to replace the external tubular shape. A ½" OD solid steel rod has a stiffness (E*I) of approximately 88,925 lbs-in$^2$ and 3 fiberglass bars with each bar having dimensions of 1.25"× 0.375" together have a stiffness of about 99,000 lbs-in$^2$. Therefore the ½" solid steel rod would give similar bending characteristics to the three fiberglass bars although the oscillatory characteristics would be different but if acceptable, this steel rod could replace the three fiberglass bars. Three fiberglass bars fit nicely inside a 1.5" CPVC Schedule 40 tube whereas a ½" diameter steel rod would be very loose inside the 1.5" CPVC Schedule 40 tube and this would allow the CPVC tube to bend a greater distance before it had bent enough for the ½" diameter steel rod to take some of the load of the weight means attached at the ends of the flexible barbell. This would alter the oscillatory bending/flexing characteristics. The flexible barbells are preferably sized to accommodate standard Olympic iron disc weights with a hole in the center that is 2" in OD and the standard iron disc weights with a hold in the center that is 1" in OD. Other weights may be used such as sand bags, etc. and other iron disc weights with different diameter holes could be made to accommodate flexible barbells with different OD's but the practical range of OD's for iron disc weights is projected to be in the range of ½" to about 2½". A solid fiberglass rod with a flexural modulus of about 6,000,000 psi and an outside diameter of 15/16" has a stiffness (EI) of 227,397 lbs-in$^2$ which would enable this 15/16" diameter rod to be used as a flexible barbell in a length of about 90 inches by itself eliminating the need for a tube although this diameter bar would be used with standard disc weights that had a 1" diameter hole or the ends of this 15/16" diameter shape could be retrofitted with a covering that would enable the use of Olympic size disc weights with 2" diameter holes, and this bar could be coated with a LineX XS-350 polyurea material in order to offer additional exterior protection. Acceptable composite solid round pultruded shapes are available from Glasforms, Inc. of San Jose, Calif. Solid steel tubular shapes are available from a variety of sources such as Ryerson Inc. of Chicago, Ill. In addition to defining the stiffness of the flexible barbell, the minimum and maximum amount of weight that is placed on a flexible barbell is to be defined for each flexible bar construction.

A particularly suitable flexible bar is a fiberglass pultruded rectangular shape with dimensions of ¼" thick×¾" wide×91⅜" in length. The fiberglass shapes were manufactured by Trench Electric in Toronto, Canada. Two of the fiberglass rectangular shapes were inserted into the center cavity of a 1.0" CPVC extruded tube. This fiberglass rectangular shape has a flexural modulus of approximately 5-6 million psi. A material such as round ⅜" diameter foam backer tubing that is traditionally used as an insulation type of material to plug gaps around windows may be wrapped around the 1.0" CPVC extruded tube and secured at each end of the CPVC tube using a piece of duct tape. This wrapping of the ⅜" foam backer tubing takes up some space between the outside of the 1.0" CPVC tube and the inside diameter of the 1½" diameter PVC schedule 40 tube into which the 1.0" CPVC tubing will be inserted. This foam backer material serves to dampen any noise from the movement of the CPVC tubing inside the PVC tubing.

It is particularly preferred to apply end caps or plugs to the end of the elongated shape for aesthetics and to prohibit the internal flexible bars from sliding out of the elongated shape. For example, 1.0" CPVC end caps can be affixed to each end of 1" CPVC extruded elongated shape. The 1.0" CPVC cap fits over an end of the 1" CPVC extruded pipe. A suitable end plug is a 1½" plastic mechanical pipe plug from Oatey® of Cleveland, Ohio. The wing nut of the Oatey pipe plug adds about 13⁄16" to the length of each end of the 1½" PVC extruded tube.

It is preferable to add a surface treatment, such as a coating or a wrap, to the exterior of the elongated shape. A material suitable for demonstration of the invention is 3M Safety-Walk™ Anti Slip Tape in Grey color available from ACE hardware as code 64175. This tape contains a slip-resistant surface of a durable rubber-type material which is comfortable to the hands and allows the user to grip the surface of the flexible barbell plus the wrap increases the OD of the 1½" PVC tube so that the circular barbell weights have a reduced tendency to slip on the surface of the barbell. Velcro® strapping such as 'hook' and 'loop' 1" wide strapping can be used to wrap around the flexible barbell on the outside and inside of the circular weights that are placed on each end of the flexible barbell. This Velcro® strapping prevents the disc weights from sliding off of the 1½" PVC tube.

Additional apparatus constructions may be used as long as they provide the user with acceptable oscillation amplitudes and oscillation frequencies with weights affixed to each end of the flexible barbell as have been achieved with the above preferred embodiments in the performance of at least one lifting method. Speed of movement of the hands of the person doing the lifting in applying forces to the center of the flexible barbell in conjunction with the physical properties of the flexible barbell being used, the amount of weight on each end of the flexible barbell plus the length of the movement of applied forces. The length of the arm extension in performing a bench exercise determines the oscillation amplitude and oscillation frequencies of the flexible barbell during the use of the flexible barbell with one requirement being an acceptable perceived responsiveness of the flexible barbell. This is determined by the user of the flexible barbell.

A rate of movement of the hands of the individual that grasp the flexible barbell is preferably between 1 and 5 feet/second. An acceptable means for determining acceptability of alternative constructions is the stiffness of the flexible barbell. Stiffness is defined as the product of E (material modulus)×I (moment of inertia of the shape being used). An apparatus with an exterior circular shape is preferred but other shapes may be used as long as the shape exhibits acceptable oscillation amplitude and oscillation frequency.

Training with the flexible barbell provides the lifter with added safety and builds muscular force strength, muscular velocity strength, muscular endurance strength, increase the speed of muscle contraction, and enhances the ability of the various supporting muscles, ligaments and tendons to work together more effectively for potential enhancement of the affected movements by training the sensory receptors, or proprioceptors, in the muscles and tendons to be more aware of the relative position of the various muscles groups.

There are many lifting movements where the use of a flexible barbell can enhance the specific training. Most lifting movements using a flexible barbell are similar to the movements when using a standard steel barbell. Because the weights at or near the ends of the flexible barbell are moving in an oscillatory manner with an amplitude in response to the forces exerted by the lifter on the center section of the flexible barbell, the methods of using a flexible barbell effectively are different from the methods used when lifting with a steel barbell.

Resistance training falls into two primary categories: speed resistance training and force resistance training. In speed training the lifter will use a submaximal amount of weight and the muscle response and activation will be faster than in force training. In force training, the lifter will use maximal weight, consequently muscle activation will be slower than in speed training. Use of a flexible barbell permits new methods to be used to achieve maximum results surpassing the results that are achievable when using standard steel barbells.

The contraction of one's muscles, when they activate, are either eccentric or concentric contractions. The weights at the ends of a flexible barbell can move in the same and opposite direction from the direction of movement of either the arms or body of the lifter during both the eccentric and concentric contraction phase of muscle movement. Depending on the objectives of the training, the lifter, when the muscles are approaching the end of the eccentric contraction, can develop a timing response for the weights to fully bottom-out before engaging the muscles in the concentric contraction phase which is supported by 'The Sliding-Filament Model of Muscular Contraction' which is specific to Force training. This model was independently developed by Andrew F. Huxley and Rolf Niedergerke and by Hugh Huxley and Jean Hanson in 1954. The timing response is part of the new method in using the flexible barbell most effectively. Response timing, wherein the lifter waits for the weights to bottom-out, results in a new and novel method for lifters to perform. The lifter will want to wait until the weights bottom-out in order to allow the muscles to take the maximum load (Sliding-Filament Model) which will be greater than the total amount of weights placed on the ends of the flexible barbell due to the effects of momentum of the moving weights. And while the lifter is waiting for the ends of the flexible barbell to bottom-out the ancillary supporting muscles will be activated and conditioned as the lifter must control the movement of the flexible barbell. This method results in training focusing on building additional strength through Force training.

But the lifter can alter the above method and before the weights bottom-out in their movement, the lifter can begin the concentric phase of muscle contraction for Speed training. The lifter moves and pushes against a force that is increasing to the point where the weights bottom-out. This places an increasing stress on the skeletal muscular system. The focus of this type of 'new and novel' movement is to enhance the ability of the targeted muscles to 'fire faster' so the net result is the lifter's ability to move their hands and arms faster. This occurs with a football lineman who will keep their elbows in a bent position and their hands 6-8 inches away from their chest. Therefore, moving their hands and arms, using concentric muscle contractions to full extension that will make contact with the opposing player. A football player wants to be able to move the arms as fast as possible so he can be the first to make contact and gain an advantage over the opposing player. This 'new' speed training method trains the muscles to contract faster. The same principal applies to a lifter that would be performing squats in which the legs are bending at the knees vice the bending of the arms. As the legs bend downward in the squat the weights at the ends of the flexible barbell bend downward and when the lifter moves upward before the weights have bottomed-out for Speed training, the continued downward movement of the weights places increasing stress on the muscles of the legs, quads and hamstrings, resulting in training that will allow the muscles to 'fire faster' resulting the football player being able to extend their legs faster from a bent position enabling them to move their bodies faster and make contact with the opposing player quicker and with more 'power' with the combination of force and speed.

The lifting methods using a flexible barbell for the greatest benefit in developing muscle strength and power feature several common features. A basic feature in the majority of exercises using a flexible barbell is to challenge the muscles in a unique way during the eccentric phase of the exercise. Muscles can handle about 40% more weight during the eccentric phase of weightlifting than the concentric phase. During this phase, which is also called the negative phase, the weights at the ends of the flexible barbell will continue in a downward movement once the user has come to a stop due to the flexing of the flexible barbell and the momentum of the downward moving weight. This downward momentum of the downward moving weight places greater stress on the user's muscles during this eccentric movement. This flexibility is dramatically demonstrated when performing a squat with the flexible barbell behind and resting on the back of the user's neck. During the downward (or eccentric) movement of the user, the weight will continue moving downward as the user stops and reverses the movement direction to up. Then during the upward movement of the lifter, the weights at the end of the flexible barbell will change direction and the force of the flexing fiberglass bars will cause the weights to accelerate slightly in the upward direction. When the user is at the full upright position, the flexible barbell is still moving up which during this upward movement has slightly reduced the stress on the user during this lifting or concentric phase of the movement which is an enhancement due to the use of the flexible barbell given the fact that fatigue will set in more quickly during the concentric phase than the eccentric phase because the eccentric phase can handle almost 40% more weight than the concentric phase. And when the oscillation characteristics of the flexible barbell are in harmony with the up and down movement of the user during the squat exercise, the user is able to maintain a rhythm which results in more effective transfer of the forces encountered by the user during the exercise to the muscles resulting in better muscle conditioning, greater ability in training the muscles to fire more responsively or respond faster and more effectively during use and better conditioning due to greater loads being transferred to the muscles during the eccentric phase that is enabled through the use of a properly designed flexible barbell in combination with the correct amount and positioning of the circular weights. If an exercise can be performed at high enough frequency rate, then the ability to train the muscle, tendons and joint sensory receptors is made possible. A flexible barbell exercise where this is more applicable is a bench press with rapid up and down movement with the flexible barbell constructed to move up and down at a frequency that is in harmony with the up and down movement of the individual's arms. Other types of lifts to which this applies are the jump squat and split jump squat.

Another benefit to the weightlifter is the fact that because the flexible barbell bends in the center, the load of the flexible barbell is transferred to the lifter in a different manner than with a steel barbell. With the flexible barbell bending in the center, the loads in a back squat are transferred more to the sagittal planes of the body instead of the spinal column which decreases stress on the vertebrae with the loads transferred to the large shoulder muscles and the ankle, knee and hip joint which reduces the risk of a spinal injury and makes the training process safer and more effective for the lifter in pre, during and post competition. This will enable the lifter to train with greater velocity or speed due to using submaximal weight. By using submaximal weight the force-velocity relationship will be greater than with a steel barbell, and increase the amplitude and oscillatory factor which will stimulate to a higher level the neuromuscular system and increase the firing (contraction speed) of the muscle. This use of submaximal weight in combination with faster lifting movements is unique with a flexible barbell and not possible with a steel barbell as a steel barbell does not bend and does not allow for the momentum gain which occurs when the ends of the flexible barbell bends.

Using submaximal weight means using a weight which is roughly 60% or less of maximal weight, which gives the lifter the ability to apply more velocity to the lift. This enables the central nervous system to be more stimulated in a sense of firing (or contraction speed) the muscle. The rigid steel bar is great for developing force, or strength, but is difficult to use in a manner that the flexible barbell gives in the development of coordination, balance, rhythm, speed, plyometric and reversal movements. Because the ends of the flexible barbell move during the lifting movements, the athlete must concentrate on maintaining body balance and coordination of the various muscles that are being used, and this promotes better coordination among the various muscles and an increased ability to move the body in a more stable and balanced manner. Also, the athlete's sense of awareness, or proprioception, of the various parts of their body engaged in the lifting process is enhanced due to the conditioning of the muscles being used under the combination of the weight of the flexible barbell and weights on the flexible barbell plus the added velocity due to the movement of the ends of the flexible barbell. This promotes an ability for the athlete to use the various parts of their body and the muscles that move these body parts in a more effective manner.

The lifter lowers a steel bar to the chest and the steel barbell is rigid, in which case the lifter could possibly drop or bounce the steel barbell on the lifters chest resulting in possible injury. The flexible barbell bends in the middle thereby minimizing the chance of chest injury due to the weight shifting to the sagittal plane of the body moving the weight from the center of the chest area to the outside edges of the body. As the lifter unracks the weight, the ends of the flexible barbell bend downward and the flexible barbell begins oscillating which develops core and shoulder stability which is very beneficial in athletic competition. As the lifter lowers the weight they are able to work different movements with the flexible barbell. The first, being a normal lowering and pressing of the flexible barbell. The second is a more plyometric or reversing of the flexible barbell. As this lift is performed the greater the velocity and force that is applied by the lifter the greater the amplitude of the oscillating ends of the flexible barbell and the greater the neuromuscular development implications. This lowering of the weight using the above mentioned normal method and the alternative method of the lowering being a more plyometric or reversing can be applied to other methods of lifting such as a back squat wherein the legs are effecting the lowering of the body rather than the arms, and the rate of lowering and then raising up effects the amplitude of the oscillating ends of the flexible barbell. Also, at the down or up position, there can be a slightly pause which affects the transfer of the weights to the muscles and joints of the body to allow the lifter to train effectively in a variety of ways.

Another benefit of the flexible barbell is the rehab methods of uses. These includes lifts that are loaded on the back such as a back squat, but not limited to the back that enables the lifter to rehab from hip, knee or ankle injuries/surgeries. This gives the lifter the ability to load sub-maximal weight that will enable them to develop coordination, balance, rhythm, and the ability to train the muscle to fire more effectively again through the proprioception process. This process enables the muscle to reverse or respond to the resistance that is applied through neuromuscular responses that train the muscles to perform or respond with greater accuracy, control and power during the rehab process.

Another significant aspect of the flexible barbell which alters the methods of lifting is the ability to move with the flexible barbell and not stay in a stationary position. For example the jump squat or the split jump squat. The flexible barbell moves with the body and deloads the stress off the spine due to the loading of the sagittal plane instead of the spine. The flexing up-and-down of the flexible barbell enables the athlete to move up and down, back and forth and side to side. During the flexing of the ends of the flexible barbell the weight is transferred to the supporting muscles in a softer and gradual manner as opposed to the instantaneous manner of a steel barbell. During this movement, the muscles that surround all the joints in which stress is being applied are working in a more conducive way that relates to athletic movement.

The athlete can use the flexible barbell for force training because of the ability to load heavy weight on the flexible barbell. The lifter or athlete can use the flexible barbell in a dynamic manner in which they are more focused on developing the central nervous system to train the muscles to fire more effectively. They can use the flexible barbell for balance and coordination purposes through the oscillating effect of the flexible barbell's movement. The lifter or athlete can use the flexible bar as a prehab or rehab tool to develop the muscles, the muscle attachments and the firing mechanisms that surround the joints being exercised. They can also use the flexible barbell in mobile capacity in which they move from a stationary position into a mobility action such as a jump squat. Their anaerobic capacity can be greatly enhanced due to the endless possibilities for altering the methods of lifting that the flexible barbell allows them to do.

Many athletes perform multi joint movements when they compete. A flexible barbell allows the multiple joints to be developed in different and unique ways. For example the back squat allows the athlete to train the joints of the lower sagittal plane that consists of the ankle flexion/extension, knee flexion/extension, hip flexion/extension and the trunk flexion/extension. There are at least 43 muscles around these joints that are being developed, not to mention the muscle attachments and the central nervous system (CNS). Furthermore, if we were to complex the lift and add a clean and jerk to the movement, the athlete would then be able to develop the shoulder flexion/extension, elbow flexion/extension and the wrist flexion/extension. This increases the muscles exercised by 15, which would give you a total 58 muscles around the joints of the sagittal plane being developed. Steel barbells do not support the lifting methods that permit this type of training.

The below lifting movements will be described and reference will be made to the above described new methods applied for both Force training and Speed training as they apply to each individual lifting movement. These new methods are directly related to the oscillatory movement of the ends of the flexible barbell when weighted means are affixed at or near the ends of the flexible barbell.

Force Training is the ability to activate muscle contraction against an opposing force that is applied through the flexible barbell. In amplitude speed training the muscles are trained to fire, or contract, with greater efficiency and/or greater speed through stimulation and training of the sensory receptors, or proprioceptors, located in the muscles and tendons with the muscles training against the resistive forces produced in the use of a flexible barbell.

Oscillatory training enhances sensory receptor stimulation wherein the ability of the sensory receptors to enhance stabilization of the muscle contractions is enhanced through the use of the oscillation characteristics of the flexible barbell.

Plyometric training improves muscle responsiveness, which results in improved muscle power, through the up-and-down or back-and-forth movements of the ends of the flexible barbell in which the muscles are rapidly lengthening more effectively followed by a more effective explosive muscle shortening movement that trains the targeted muscles to fire faster and produce a stronger muscle contraction.

The oscillatory movements of a flexible barbell promotes rehabilitation of the sensory receptors and facilitates the ability of the injured muscles to fire, or contract, more effectively following surgery, tear or sprain.

Many standard exercises can be enhanced with the flexible barbell including upper body exercises such as bench press, inclined bench press, shoulder press, bent over row and bicep curls; lower body exercises such as back squat, front squat, lunge walks, good mornings, dead lifts and box squats and total body explosive exercises such as power clean, hang clean, push jerk, push press, broad jump, vertical jump, split jump, Zercher push pull, power shrugs and high pulls, Additional weight-lifting procedures are detailed in http://www.myweightlifting.com/bench-press-tips.html.

Bench press for force training can be performed by loading the flexible barbell with a maximum load. The lifter takes the flexible barbell from the chest to lockout position, where the arms are fully extended, in a controlled manner and repeating. Bench press for speed training can be performed by loading the flexible barbell with a submaximal weight, such as 60% or less of one's body weight, and moving the flexible barbell rapidly in an up and down motion. Bench press for oscillatory training can be accomplished for speed and force movements. An example includes overloading the flexible barbell and holding the flexible barbell in a lockout position. The flexible barbell will naturally oscillate as a result of the upward forces applied to the approximate center of the flexible barbell during the initial bench press movement immediately preceding the lockout. The oscillating ends of the flexible bar force the sensory receptors, or proprioceptors, to be activated to balance or control the movement of the flexible barbell. This conditions the muscles and tendons in the joints to function together which enhances the athletic performance of the individual.

Inclined bench press for force training can be performed by loading the flexible barbell with a maximum load and taking the flexible barbell from chest to lockout position in a controlled manner repeatedly. Inclined bench press can be performed for speed training by loading the flexible barbell with a submaximal weight, such as 60% or less of one's body weight, and moving the flexible barbell in a rapid up and down motion. The flexible barbell can be used for oscillatory training by overloading the flexible barbell and holding in a lockout position while the flexible barbell oscillates as a result of the upward forces applied to the approximate center of the flexible barbell during the initial inclined bend press movement which immediately precedes the lockout. The oscillating ends of the flexible barbell force the sensory receptors to be activated to balance or control the movement of the flexible barbell as in the bench press.

Shoulder press for force training can be performed by loading the flexible barbell with a maximum load and moving the flexible barbell from between the chest and chin to a lockout position parallel to the body in a controlled manner and repeating. Shoulder press for speed training can be performed by loading the flexible barbell with a submaximal weight, such as 60% or less of one's body weight, and moving the flexible barbell rapidly in an up and down motion. The flexible barbell can be used for oscillatory training by overloading the flexible barbell and holding the flexible barbell in a lockout position while the flexible barbell oscillates as a result of the upward forces applied to the approximate center of the flexible barbell by the lifting motion preceding lockout.

Bent over row can be performed by loading the flexible barbell with a submaximal load and pulling the flexible barbell from the lockout position to the navel. The flexibility of the flexible barbell allows for force, speed and oscillatory training.

Tricep extensions may be performed by loading the flexible barbell with a submaximal load and extending the triceps from behind the head to over the head with arms fully extended and palms facing up. The flexibility of the flexible barbell permits force, speed and oscillatory training.

Bicep curls can be performed by loading the flexible barbell with submaximal weight and moving the flexible barbell from the hips to the upper chest in a standing curling movement with multiple repetitions. During the lower phase, or eccentric phase, of the movement the flexible barbell allows for a greater load to be transmitted to the bicep muscle dues to the momentum gain from the downward movement of the moving weights which permits an enhanced stretching of the bicep muscle at approximately the end position of the lowering phase. In the enhanced stretch position the individual has placed the bicep muscle in a position such that in the following concentric lifting phase the bicep is able to be trained to contract faster due to the bicep muscle being stretched more effectively during the eccentric phase.

A back squat and front squat can be performed for force training by loading the flexible barbell with the maximal load and moving from a standing position to a squatted parallel position where the quadriceps are parallel to the ground and back to a standing position. In the back squat the flexible barbell is behind the neck whereas with front squat the flexible barbell is in front of the neck. The angle of the back is different for the two squats to maintain the weight over the centerline and feet. Because the flexible barbell bends in the center with the weights on each end of the flexible barbell bends across the back and shoulder of the lifter and therefore the load is not concentrated on the centerline of the body but instead are moved outwards towards the shoulders which allows the lifter to more effectively handle the load with the weight of the flexible barbell and weights being divided between each of the sides of the lifters shoulders as opposed to being concentrated on the centerline of the body. Speed training can be performed with the back squat by loading a submaximal load on the flexible barbell and moving in a rapid pace from standing to a squatting parallel position and back to a standing position. During the eccentric, or downward phase, of the squat the ends of the flexible barbell will bend downward to a greater degree as the lifter approaches the end of the downward movement. This continued loading of the muscles as a result of the downward movement of the loading of the muscles as a result of the downward movement of the ends of flexible barbell causes the sensory receptors in the muscles and tendons to be activated at an enhanced level resulting in more training and conditioning of the muscles involved in this squat exercise with one potential benefit being enhanced speed or contraction of the quads and hamstrings resulting in greater power movement by the lifter. The oscillatory training effect will take place naturally as the flexible barbell oscillates while the lifter performs the squat in a force or speed exercise.

Zercher squats for force training may be performed by loading the flexible barbell with maximal load and moving from a squatted position to a parallel position wherein the quadriceps are parallel to the ground back to the standing position while the flexible barbell is cradled in the cuffs of the elbow. The Zercher squat lowers the weight from the shoulders to mid-torso. As the lifter moves down during the squat and approaches the limit of the squat the ends of the flexible barbell will continue to move down which accentuates the load felt by the lifter thereby making the squat more difficult resulting in a greater ability for strengthening the glutes and hamstrings. Speed training can be performed with the Zercher squat by loading a submaximal load on the flexible barbell and moving in a rapid pace from standing to squatting parallel position and back to a standing position. The movements are more rapid than in force training and the loads transferred to the lifter's muscles are accentuated more than in the force Zercher squats with the benefit to the lifter being development of greater muscle strength targeted to the hamstrings and glutes. In addition, the fast pace of the speed training promotes sensory receptor stimulation and training with a potential for more effective use of the legs for sports specific uses. The oscillatory training effect will take place naturally as the flexible barbell oscillates while the lifter performs the Zercher squat in a force or speed manner.

Lunge walks can be performed by loading the flexible barbell on the lifters back, front shoulders or in the cuffs of the elbow followed by a forward or backward lunge step while assuring the shins are vertical and the quadriceps are parallel to the ground. Because the flexible barbell bends as the lifter approaches the end of the lunge movement the forces transferred to the lifter's muscles are enhanced thereby forcing the surrounding muscles to assist in stabilization making the lunge a more beneficial movement resulting in a greater ability to condition the targeted muscles and ancillary supporting muscles.

Good mornings can be performed by loading the flexible barbell on the lifters back followed by the lifter bending over while pushing their hips back until the desired amount of resistance is felt on the hamstrings, glutes and spinal erectors. As the lifter bends over and approaches the end of the bend the flexible barbell will continue to bend downwards forcing surrounding muscles to assist the body in stabilizing which results in conditioning of a greater number of muscles and surrounding tendons. As in a back squat this lift is made safer when using a flexible barbell since the flexible barbell bends in the center with weights on each end of the flexible barbell and the loads transferred to the outer parts of the body.

Dead lifts can be performed by loading submaximal to maximal weight on the flexible barbell and pulling the flexible barbell from the floor until the hips are locked in a standing position. The oscillation of the ends of the flexible barbell require the ancillary muscles to assist the body in stabilizing during this movement thereby increasing the conditioning benefit to the supporting ancillary muscles. As the lifter moves up from the standing position the weight of the flexible barbell will be increased due to the momentum of the weights flexing having momentum downward which the lifter has to encounter which results in greater conditioning due to the enhanced loads.

Box squats can be performed by using a box that is positioned at a height that allows the lifter to perform a parallel squat while sitting back on the box. The lifter loads the flexible barbell on the back with submaximal weight that enables the athlete to move into a speed training movement. The flexible barbell enables the lifter to more effectively develop the quads, glutes and hamstrings due to the fact that during speed training the ends of the flexible barbell continue to flex down following the sitting down of the lifter and with the lifter immediately exploding up from the sitting position with the ends of the flexible barbell moving down which places a greater load due to the moment which requires the lifter to exert more force as the lifter pushes up initially using the glutes followed by the quads.

The Power Clean can be performed as a ground base speed movement using the flexible barbell and submaximal weight. The Power Clean lift is benefitted more from a speed training standpoint than force training because of the flexible barbell's ability in use to stimulate the nervous system, which will help muscles respond and react faster. The flexible barbell aids in this process by overloading the muscle sensory system from a reactive, responsive and coordinated effort that can be transferred to the action of sport or to the action of lifting, jumping, running or movement in general.

The Hang Clean can be performed as a ground base speed movement using the flexible barbell and submaximal weight. The Hang Clean lift is benefitted more from a speed training standpoint than force training because of the flexible barbell's ability in use to stimulate the nervous system, which will help muscles respond and react faster. The flexible barbell aids in this process by overloading the muscle sensory system from a reactive, responsive and coordinated effort that can be transferred to the action of sport or to the action of lifting, jumping, running or movement in general.

The push jerk develops multi joint explosive power and can be performed from a force movement or a speed movement. Oscillating movement is realized as the lifter stabilized and controls the top end of the lift due to the flexing of the ends of the flexible barbell. The lifter presses the flexible barbell from the top of the chest to overhead in the frontal plane of the lifters body. This can also be done off of the back shoulders which builds explosive power as the lifters ankle, knee, hip and shoulder joint work in sequence to lock the flexible barbell out over the lifters head. The power generated in this movement should cause your feet to leave the floor.

The push press can be performed with both a force movement and a speed movement. Oscillating movement of the flexible barbell occurs as the lifter stabilizes and controls the top end of the lift due to the flexibility of the flexible barbell. The lifter presses the flexible barbell from the top of the chest to overhead in the frontal plane of the body. This can be done off of the back shoulders as well and builds explosive power as the lifters ankle, knee, hip and shoulder joints work in sequence to lock the flexible barbell out over the lifters head. The feet should remain in contact with the floor.

The broad jump, vertical jump and split jump are very difficult to accomplish safely with a standard steel barbell but due to the flexibility of the flexible barbell the lifter is able to move more freely and less rigidly as they perform broad jumps since the flexible barbell bends to absorb the force through the lower levers and then reapplies force as the lifter jumps.

The Zercher push pull benefits greatly from the flexible barbell. The flexible barbell gives the resistance of a push-pull movement that can develop balance and coordination in athletes, particularly football players. The flexible barbell sits in the cuff of the lifters elbows and as the lifter moves back and forth in a power position the ends of the flexible barbell move back and forth giving the sensation of a push-pull movement which is counter to the movement of the athlete.

Power shrugs or high pulls can be performed using a flexible barbell and are particularly preferred prior to performing a power clean or hang clean using a standard rigid steel barbell. The flexible barbell allows the overloading of the muscles due to the bending of the flexible barbell which provides for increased weight transfer to the affected muscles due to the momentum of the flexing flexible barbell which engages the sensory receptors resulting in the ability of the muscles to fire at a faster rate with resulting faster movement of a standard steel bar. The power shrug using the flexible barbell stimulates the muscles and sensory receptors in a way that they fire the nervous system which creates a muscle memory and when lifting a steel barbell the affected muscles remain actively firing and this condition helps transfer greater force to the steel barbell thereby enabling faster movement of the standard steel bar.

EXAMPLES

Example A

A 90" length of Schedule 40 extruded chlorinated polyvinyl chloride (CPVC) with an inside diameter (ID) of 1.5" and an outside diameter (OD) of 1.61" from IPEX America of Pineville, N.C. was used to prepare a bar suitable for accommodating at least 300 lbs of total weight with the oscillation amplitude and oscillation frequency acceptable to the user when the hands are moving during the concentric and eccentric lifting phase of a bench press at a speed that may vary between 1 and 5 feet per second with the speed of the hands adjusted by the user to accommodate the training objectives with each hand positioned on each side of the centerline of the flexible barbell at a distance from 8" to 24" with 8.5" to 9.5" being the most common position for the hands from the flexible barbell's centerline.

The flexible barbell was coated with a thickness between 40 and 50 mils of Line-X® spray polyurea coating, XS-100, with a top coat of about 3 mils of Line-X®'s AspartX® black coating to give a tougher surface.

The expected deflection of each end of the flexible barbell with a defined amount of weight on each end of the flexible barbell using the equation for a simply supported beam where 2 concentrated loads are symmetrically applied. The two concentrated loads represent the weights applied to each end of the flexible barbell with the flexible barbell supported in the center using 2 hands spaced 8.5" on each side of the flexible barbells centerline. From *Strength of Materials* by Robert W Fitzgerald Copyright 1967 by Addison-Wesley Publishing Company, Inc.; pg 381 deflection at the end of the flexible barbell using the equation:

Deflection=[[*P*(weight on one end of bar=135 lbs)* [(Length of bar section: 90"−17")/2]]/(24*EI) (with EI=216,256 for the construction of this bar)]*((3*$90^2$)−(4*$36.5^2$))=18" or converting to the angle from horizontal=35 degrees.

When performing a squat or a jump squat with the flexible barbell positioned behind the head and resting along the shoulders of the lifter, the flexible barbell is expected to respond acceptably with up to 500 lbs of total weight.

A 54" long 3" inside diameter (ID) piece of clear 0.045" thick heat shrink tubing, purchased as BuyHeatShrink® tubing (polyolefin) from Deerfield Beach, Fla. 33064 was applied over the outside surface of the CPVC tube following coating of the CPVC tubing with the LineX material and centered along the 90" length of the CPVC tube. The shrink tubing had a shrink ratio of 2:1. The 54" long piece was selected due to the observation that 3" wide metal bar support brackets are provided on a standard barbell lifting rack which are about 21½" from the centerline (CL) of the flexible barbell. The brackets are 3" wide and an extra length of 2½" was added for safety suggest a length of 54" for the heat shrink tubing. The heat shrink tubing is a preferred option which provides benefits for the user of this flexible barbell. The heat shrink tubing provides a better gripping surface for one's hands when using the flexible barbell and increases slightly the OD of the Line-X® coated surface so that the 2" ID×6" long rack support pads will fit tight to the outside surface of the flexible barbell when installed at a distance of approximately 21" each side of the centerline of the flexible barbell. The rack support pads provide protection for the surface of the flexible barbell as it is place in and taken out of the rack support brackets on the lifting rack.

Three 86.75" pultruded fiberglass reinforced plastic bars with dimensions of 0.375"×1.25" were inserted in the flexible tube. The plastic bars were supplied by Glasforms, Inc. of San Jose, Calif. and each end of the plastic bars was beveled to prevent the ends from cutting into the CPVC inside wall. Each bar was a vinyl ester resin to better insure long flex life reinforced with 65% weight percent continuous fiberglass rovings.

The fiberglass bars were inserted into the cavity of the CPVC tube and a rubber end cap plug was inserted and glued into each end of the CPVC tube. The entire bar was coated with the Line-X® spray polyurethane/polyurea coating, XS-100. The rubber end caps were provided by Schacht/Pfister as model BB 21B 1⅛". Krazy® superglue around the outside surface near the open end of the rubber end cap and using a twisting motion as the rubber end cap is pushed into the open ends of the CPVC tubing. Rubber end cap fits approximately 1⁵⁄₁₆" from the open end of the CPVC tubing into the cavity of the CPVC tubing thereby provided a finished length of flexible bar of about 90.75"

Two ½" diameter holes were drilled, approximately 1¼" from the end of the rubber end plug, through the wall of the Line-X® coated CPVC tube and the wall of the rubber end cap plug for receiving a hitch pin with a diameter of ⅜"×2½". The hitch pins were provided by Hillman and identified as a 'Wire Lock' pin square with product code 08236 77004. A ⁵⁄₃₂" pilot hole was drilled before the ½" final hole was drilled. A template was used to mark the center of each hole with the holes positioned on opposite sides of the extruded flexible tube and each hole is 1¼" from the end of the tube with the holes positioned 180 degrees from each other. The open end of the rubber end plug that extends toward the interior of the CPVC tube from the hitch pin prevents the fiberglass bars from becoming wedged between the hitch pin and the inner wall of the tube thereby allowing the fiberglass bars to rotate freely inside the extruded flexible tubing.

Indicia, in the form of numbers, were stenciled onto the surface of the Line-X® coating before application of the heat shrink tubing. Starting with numbers 1 inch from each of the knurling line indicators, 8.5" from centerline of the tube, with numbers going from 1 to 18 in 1 inch increments. The numbers were ½" high and stenciled onto the surface of the Line-X® coating using a flexible plastic number stencil and a 'Metallic Silver' Sharpie® permanent marker. Logo labels containing Safety Caution information plus Instructions for using the bar, such as peel-n-stick labels, were applied to the surface of the flexible barbell as desired. The indicia and labels were placed prior to the heat shrink tubing being applied.

Wear pads can be installed if desired. Long tubular wear pads were installed by applying a liquid soap solution to the outside surface of the barbell and the inside surfaces of the 6" long flexible tubular wear pads and pushing the 6" long tubular wear pads from each end of the barbell to a position such that the 6" long tubular wear pad covers 6" of the end of the previously applied 54" long heat shrink tubing. The wear pad material was 2" ID extruded nylon with a braided material in the center for extra strength and was available as NEXBRAID® NT from NEXGEN Hose 120-32 from Dixie Rubber & Plastic, Inc. of Greenville, S.C. Double sided tape or an adhesive such as Krazy® superglue can be used to fix the position of the wear pads to the surface of the heat shrink tubing or LineX coated surface.

One or more 'collars' may be attached along the length of the flexible barbell at or near each end to position the disc weights along the length of the flexible barbell and/or to fix the position of the disc weights along the flexible barbell's length. A suitable collar is made by BFS (BiggerFasterStronger.com) and is identified as their item number 320095. This collar features a rubber type liner with a Velcro® strap webbing material used to secure the collar to the flexible barbell surface. The length of the collar is about 2⅜".

After placing the weight on the flexible barbell the hitch pins are inserted through the ½" diameter holes previously drilled through the flexible barbell at each end of the flexible barbell.

Example B

A flexible barbell was prepared as in Example A with the exceptions listed below. A polypropylene (PP) extruded 1½" Schedule 40 flexible tube used which is not as stiff a polymer as the CPVC material. The polypropylene polymer is hypothesized to provide a flexible barbell with greater long term use because of the increased tensile elongation properties of the polypropylene material as compared to polyvinylchloride (PVC) or CPVC. It may last longer in a flexing mode than PVC or CPVC. Also, the flexural modulus of the polypropylene ($1.2\text{-}2.7\times10^5$) is lower than PVC or CPVC (about $4\times10^5$).

The flexible barbell was not coated with Line-X® spray polyurea due to the difficulty associated with getting materials to stick to the surface of polypropylene and the polypropylene material is hypothesized to be more abuse resistant than PVC or CPVC so this example was produced without a Line-X® coating. But since the LineX® polyurethane/polyurea coating totally encapsulates the tubing plus end cap plugs, a LineX spray material could be used.

The PP tubes were purchased as Enpure® natural Polypro Type II per ASTM D4101 pipe from IPEX America of Pineville, N.C. The tube had an ID=1.568" and wall thickness is 0.166".

Two different size bars were used due to the thickness of the tubing. Two pieces of fiberglass pultruded bars each 0.375"×1.25"×86.75" and one piece of fiberglass pultruded bar at 0.312"×1.25"×86.75" was used with the 0.312" thick piece placed between the two pieces of 0.375" thick bars. Together they fit easily into the cavity of the 1.5" polypropylene Schedule 40 pipe. The fiberglass bars had an isophthalic polyester resin with continuous fiberglass rovings with 65% weight percent fiberglass reinforcement. The ends of each fiberglass pultruded bars were beveled so that the sharp cut ends of the fiberglass bar would not damage the inside wall of the extruded flexible tube.

Example C

A flexible barbell was prepared as in Example A with the exceptions of the coating which was between 45 and 60 mils of Line-X® spray polyurea coating with a top coat of about 3 mils of Line-X®'s AspartX® black coating to give a tougher surface. This proved to be a heavier Line-X® coating than acceptable with the Olympic Disc weights being a little hard to slide onto the bar so the 'new' range of Line-X® coating is 40 to 50 mils with a nominal of 45 mils plus the 3 mils of AspartX® top coat.

The fiberglass bars were isophthalic polyester resin with 65% weight percent continuous fiberglass rovings.

Example D

A flexible barbell was prepared as in Example A with the exceptions of the tubing which was produced by Charlotte Pipe of Charlotte, N.C. and was otherwise the same. The flexible barbell was not coated with LineX™ but instead two layers of heat shrink tubing were used. The first heat shrink tubing was a 91" long, 2" ID, 045" thick, black polyethylene with a shrink ration of 2:1 provided by Nelco Products—South; Clearwater, Fla. 33760 as Product ID: NP-221. The second heat shrink tubing was 54" long, 0.45" thick, 3" OD black polyolefin from BuyHeatShrink® tubing from Deerfield Beach, Fla. 33064.

The fiberglass bars were used as in Example A with all three bars being 0.375"×1.25".

Example E

A 72" long, 1¼" OD, ID=1 11/32", Schd 40 PVC flexible tube used with one 0.375"×1.25" fiberglass pultruded bar inside. The flexible barbell is designed to accommodate at least 200 lbs of total weight with the oscillation amplitude and oscillation frequency acceptable to the user when the hands are moving during the concentric and eccentric lifting phase at a speed that may vary between 1 and 5 feet per second with the speed of the hands adjusted by the user to accommodate the training objectives with each hand positioned on each side of the centerline of the flexible barbell at a distance from 8" to 24" with 8.5" to 9.5" being the most common position for the hands from the flexible barbell's centerline. This flexible barbell was not coated with Line-X® spray polyurea but a Line-X® coating with a thickness in the range of 60 to 75 mils with 3 mils of AspartX would be suitable for demonstration of the invention. Heat shrink tubing not used but it could have be used to demonstrate the invention.

One fiberglass bar, as described in Example B, was used wherein the bar had dimensions of 0.375"×1.25"×70.25".

Also, two pieces of a 1.25" wide×70.25" long piece of 'blue' flat foam material were used with one piece on each side of the fiberglass bar inside the PVC tube to reduce the noise that the fiberglass bar makes against the inside wall of the PVC tube when the flexible barbell is oscillating back and forth.

An embodiment containing 2 rectangular fiberglass bars, each ¼" thick and ¾" wide and 91⅜" long will allow this flexible barbell to be used with a minimum weight on each end of about 25 pounds and a maximum weight on each end of the flexible barbell of about 90 pounds for a total maximum weight of 200 lbs. For uses where one would desire to put additional weight on each end of the flexible barbell, the cross-sectional area of the fiberglass composite elongated shape would need to be increased or possibly a composite tube with stiffness characteristics that would meet the increased stiffness needs. The defined preferred embodiment produces a flexible barbell with a stiffness that can be calculated by an engineer. A fiberglass bar with a width of 0.75" and a thickness of 0.400" would produce a fiberglass composite with a stiffness or bending resistance slightly more than twice the stiffness or bending resistance of the 2, 0.75" wide×0.250" thick as defined above. This alternative fiberglass shape would allow for a significant increase in the weight that could be placed on each end of the 96" flexible barbell and still have correct amount of flexibility to be used in the various weightlifting exercises such as a squat where the user would move up and down at a certain rate or speed which would allow the ends of the weighted flexible barbell to move up and down and at a rate that would be in harmony with the rate of the up and down movement of the user thereby producing beneficial results by the enhancing the conditioning of the muscles used in performing a squat. Depending on the amount of weights placed on each end of the flexible barbell, the distance the weights are placed to the left and right from the center of the flexible barbell along the length of the flexible barbell and the speed at which the person moves up and down in performing the squat exercise, the ends of the flexible barbell will move up and down at a particular frequency. If there is too much weight on each end of the flexible barbell and/or the flexible barbell is not stiff enough, the ends of the flexible barbell will bend down too much and achieving an acceptable up and down movement of the ends of the flexible barbell to be in harmony with the up and down movement of the individual performing the barbell squat will not be possible. If the stiffness of the flexible bar is too low and the amount of weight on each end of the flexible barbell is too high, then effective movement of each end of the flexible barbell is not possible when performing an exercise such as a barbell squat. Such is the case with the described preferred embodiment where 225 pounds of weight is placed close to each end of the 96" long flexible bar. Acceptable oscillation frequency and oscillation amplitude could not be obtained with 225 pounds of weight on each end of the flexible barbell. In this case, to perform the exercise effectively, the weight must be reduced and/or the cross-sectional area of the fiberglass composite must be increased which increases the bending resistance or stiffness of the flexible barbell.

An embodiment using 2 fiberglass pultruded rectangular bars that have a significantly greater cross-sectional area than in the above preferred embodiment permitting a greater amount of weight to be placed on each end of the flexible bar plus the surface of the flexible tube has been spray coated with a thermoset plastic material called a polyurethane/polyurea blend, similar to the spray on truck bed liners done by Line-X®, which provides enhanced surface durability plus the texture of the spray applied polyurea is slightly rough providing a good gripping surface.

Example F

A 96" long, 1½" PVC schedule 40 extruded pipe manufactured by Silver-Line® Plastics; Asheville, N.C. 28804 which has an approximate OD of 1.91 inches and an ID of 1 9/16" was used. The entire outer surface was spray coated using Line-X® standard black thermoset polyurethane/polyurea spray coating. The coating is applied in two passes and the approximate total thickness of polyurea applied is about 25 mils. A 1½" plastic mechanical pipe plug from Oatey® of Cleveland, Ohio was inserted to provide a finished length of flexible elongated tubing plus 1½" plastic mechanical pipe plug affixed inside each end of the 1½" PVC tube was 97.75". The wing nut of this Oatey pipe plug adds about ⅞" to the length of each end of the 1½" PVC extruded tube.

Two 94" long fiberglass pultruded rectangular bars with dimensions of 0.375" thick×1.25" wide×94" in length were inserted in the tube. This shape had a flexural modulus of approximately 5-6 million psi.

A 4" to 12" long cylindrical plastic tube, from Keeney Mfg. of Newington, Conn., in which the flange on one end has been cut off is slipped over the 2 pieces of fiberglass rectangular bars in order to minimize any abrasive effects of the cut ends of the fiberglass rectangular bars from abrading the inside surface of the PVC tube. Over the outer end of each of the plastic tube, a piece of duct tape is applied to fix the position of the plastic tube at each end of the fiberglass bars. The outside diameter of the plastic cylinder is smaller than the inside diameter of the PVC tube permitting the plastic tube to be fully contained inside the finished flexible barbell.

A standard black conventional compression cylindrical device used routinely in strength and conditioning facilities were placed over each end of the 1½" PVC tube to fix the position of the disc weights that were slid onto each end of the flexible barbell. Once the appropriate weights were slipped onto the flexible barbell an additional standard black conventional compression cylindrical device was slipped onto each end and tightened to prevent the weights from sliding off Alternately, Velcro® strapping such as 'hook' and 'loop' 1" wide strapping could be used to wrap around the flexible barbell on the outside and inside of the circular weights that are placed on each end of the flexible barbell.

A wire lock pin, round or square would suffice, was used near each end of the flexible barbell as a safety feature to insure that any weights placed on the flexible barbell do not slip off during use. As an example a 13/64" diameter round hole would be drilled through the center and both walls of the PVC tube about 1¼" from each end of the PVC tube. This is sufficient distance from the ends to still allow the compression plug to be used in each end of the tube. After the hole is drilled, a wire lock pin with dimensions of ⅜"×2½" was inserted through the hole and the square wire attachment slipped over the free end of the pin to insure that the pin did not fall out.

This embodiment was able to function acceptably with up to 225 lbs of weight placed on each end of the flexible barbell. Three of the fiberglass bars with dimensions of 0.375"×1.25" is preferred at this weight which significantly improves the responsiveness although a weight of 135 lbs on each end of the flexible barbell would make speed training more effective.

Example G

A flexible dumbbell consisting of a 20" long piece of ¾" flexible PVC tubing from Jain Irrigation, Ontario, Calif. with a flexural modulus of about 5,000 psi and inside the flexible PVC tubing is a 19⅝" long pultruded rectangular bar (0.1875"×0.500"×19⅝") with a flexural modulus of 5,500,000 psi with a 10 lb standard disc weight with a 1" diameter hole in the center on each end of the flexible PVC tubing 7.75" from the center of the tube with a rubber end cap from Schacht Pfister of Huntington, Ind. fixed on each end of the flexible PVC tube using Krazy superglue with a metal hose clamp fixed in position between the rubber end cap and the 10 lb disc weight. The maximum deflection was measured in the center of the flexible PVC tube by lifting up on the center of the flexible PVC tube until the 10 lb weights just started to come off of the floor and a deflection of 1.3" was measured. The angle of deflection, as measured by dividing the 1.3" deflection by the length, 7.75", equaled 9.5 degrees. The feel of the dumbbell was good when performing bicep curls and the oscillation of the ends of the dumbbell was controlled.

This dumbbell prototype was meant to simulate a dumbbell in which the weights on each would not be removable. The use of the metal hose clamps assured that the weights did not come off of the ends. 1" wide electrical tape was wrapped around the circumference of the flexible PVC tube just inside the 10 lb weight which prevented the weight from moving toward the center of the dumbbell.

Example H

A 90" length of Endot Industries, Inc. of New Jersey 'HDPE' (high density polyethylene) thermoplastic tubing with an inside diameter (ID) of 1.54" and an outside diameter (OD) of 1.9" with a flexural modulus of 80,000 psi was used to prepare a flexible bar to accommodate up to 300 lbs of total weight with the oscillation amplitude and oscillation frequency acceptable to the user when the hands are moving during the concentric and eccentric lifting phase of a bench press at a speed that may vary between 1 and 5 feet per second with the speed of the hands adjusted by the user to accommodate the training objectives with each hand positioned on each side of the centerline of the flexible barbell at a distance from 8" to 24" with 8.5" to 9.5" being the most common position for the hands from the flexible barbell's centerline. HDPE is expected to give longer flex life to the flexible barbell over that available with CPVC tubing due to the significantly higher elongation properties.

The flexible barbell was coated with a thickness between 35 and 45 mils of Line-X® spray 100% polyurea coating, XS-350, with a top coat of about 3 mils of Line-X®'s AspartX® black coating to give a tougher surface.

Following coating with LineX, ½" diameter holes were drilled through each end of the bar 1¼" from the end of the rubber end cap plug. Then the labels plus indicia were applied to the center of the bar over the LineX coating. Next, the heat shrink tubing at a length of 44" was applied. Then the 6" long wear pads were applied with the inside end of each wear pad positioned 21" from the centerline of the bar and covering about 1" of heat shrink tubing. Double sided tape with a liquid activator from Golfsmith International of Austin Tex., similar to the materials used in re-gripping golf club grips was applied to the surface of the LineX coating prior to sliding the wear pads onto the bar to fix the position of the wear pads. Finally, the hitch pins were applied to each end of the flexible barbell.

To give this flexible barbell sufficient stiffness (EI) to function effectively as a 300 lb rated barbell, the fiberglass shapes inside the HDPE tubing consisted of one fiberglass pultruded bar, 0.375"×1.25"×86.75" and one fiberglass pultruded solid round rod, 0.812" diameter×86.75" long, which together with the HDPE tube plus the LineX coating gave a stiffness of approximately 200,000 lbs-in$^2$.

Example I

A 90 inch long preferred embodiment using a 90 "long 1.5" CPVC schedule 40 tube and coated with a LineX XS-350 coating to a thickness of about 0.045" with 3 fiberglass bars inside the CPVC with each bar being 0.375"×1.25"×86.75" long with a flexural modulus of about 5,500,000 psi for the fiberglass bars and a single lifting force applied in approximately the center of the barbell would result in a 'static deflection' at the ends of about 5 inches with one (1) 45 lb iron disc weight placed on each end of the barbell and a static deflection of about 10 inches with two (2) 45 lb iron disc weights placed on each end of the barbell. The calculated barbell stiffness (EI) for the above flexible barbell construction is about 215,000 lbs-in$^2$ (117,000 lb-in$^2$ for the CPVC tube; 30,000 lb-in$^2$ for each of the 3 fiberglass bars and about 7,400 lb-in$^2$ for the LineX XS-350 coating. The deviation from linearity, D, during use at maximum bend of the bar will be greater that the static deflection with this maximum amount dependent on the strength of the athlete and the speed of movement of the barbell. Practical knowledge of the bending characteristics of the materials used to construct a flexible barbell suggests that the barbell will become unsafe if the acute angle $\alpha$ becomes greater than 90 degrees during use.

Comparative Example

A 90" Acrylonitrile butadiene (ABS) 1½" Schd 40 flexible tube Produced by IPEX America of Pineville, N.C. was used. The tube had an ID of 1.664" and a wall thickness=0.118". The bar was coated with between 45 and 60 mils of Line-X® spray polyurea coating with a top coat of about 3 mils of Line-X®'s AspartX® black coating plus a 3 mil top coat of AspartX® black coating to give a tougher surface. One layer of heat shrink tubing, purchased as BuyHeatShrink® from Deerfield Beach, Fla. 33064, was applied using several pieces over the approximate center 54 inches to provide. The heat shrink tubing was 0.45" thick, clear color with a 3" OD and a 2:1 shrink ratio. Length 54" with 3 pieces used to give the 54 inches and positioned in the center of the tubing. Three 86.75" fiberglass bars, with beveled edges were used in the ABS. The fiberglass bars had cross-sectional dimensions of 0.375"×1.25" with isophthalic polyester resin and 65 wt % continuous fiberglass rovings. Body Bar, Inc. end caps ACO #21 used as a plug and applied into each end of the ABS tubing applying Krazy® superglue around the outside surface near the open end of the rubber end cap and using a twisting motion as the rubber end cap is pushed into the open ends of the ABS tubing. Rubber end cap fits approximately 1$\frac{5}{16}$" from the open end of the ABS tubing into the cavity of the ABS tubing to provide a finished length of 90.75". Wire lock pins were installed as described above.

This flexible barbell failed in use. A minimal amount of weight was on the flexible barbell (about 50 lbs on each end) but the method of use was jump squats which produced large oscillation amplitudes that resulted in the tube fracturing. The amplitudes were less than those which occur when the ends of the flexible barbell result in the ends of the flexible barbell, in a bent condition, being parallel to each other. The failure mode was a 'clean' fracture around the circumference of the ABS tube with the location about 6 inches from the centerline of the flexible barbell. This failure indicates that ABS in this flexural bending application is not a suitable polymer. It would appear that the ABS material simply does not have enough tensile elongation. The tensile elongation of PVC and CPVC is roughly twice that of ABS.

The evaluation of this flexible barbell using the ABS pipe manufactured by IPEX America confirms that this standard extruded pipe ABS formulation does not have sufficient flexibility to function as an acceptable flexible barbell. It is possible to add a greater percentage of the polybutadiene rubber component of the ABS material formulation such that this material might be able to be used to extruded a flexible tube that could function successfully in this application.

The invention has been described with specific reference to exemplary embodiments without limit thereto. One of skill in the art would realize additional improvements and embodiments which are not specifically set forth but which are within the scope of the invention as set forth in the claims appended hereto.

What is claimed is:

1. A flexible barbell for enhancing weight lifting exercises comprising:

an elongated shape comprising a center and ends;

at least one flexible bar in said elongated shape wherein said flexible bar has a minor axis and a major axis and is capable of rotating in said elongated shape; and weights attached to said elongated shape near said ends;

wherein said elongated shape bends relative to a tangent to said center in response to said center of said elongated shape being moved; and a hitch pin received in a void of said elongated shape.

2. The flexible barbell of claim 1 wherein said weights are symmetrically distributed relative to said center.

3. The flexible barbell of claim 1 wherein a right half and a left half of said elongated shape have consistent characteristics from said ends to said center.

4. The flexible barbell of claim 1 wherein said elongated shape bends in a static mode no more than an end tangent being 45° relative to said tangent to said center.

5. The flexible barbell of claim 1 wherein said elongated shape bends in a dynamic mode no more than an end tangent being 90° relative to said tangent to said center.

6. The flexible barbell of claim 1 having a length of at least 10 inches up to 8 feet.

7. The flexible barbell of claim 6 wherein said length is at least 5 feet up to 8 feet.

8. The flexible barbell of claim 1 wherein said elongated shape has a longest cross-section outer length of at least ¾" to no more than 3 inches.

9. The flexible barbell of claim 8 wherein said elongated shape has a longest cross-sectional outer length of at least 1" to no more than 2.5 inches.

10. The flexible barbell of claim 8 wherein said elongated shape is round.

11. The flexible barbell of claim 8 wherein said elongated shape has an oval exterior.

12. The flexible barbell of claim 8 wherein said elongated shape has a patterned surface resulting from a molding process or contact impression during extrusion.

13. The flexible barbell of claim 8 wherein said elongated shape is formed from a fiber reinforced thermoplastic and thermoset resin.

14. The flexible barbell of claim 8 wherein said elongated shape is extruded using either a reinforced or unreinforced thermoplastic resin material.

15. The flexible barbell of claim 1 having a stiffness of at least 1,000 lbs-in$^2$ to no more than 500,000 lbs-in$^2$.

16. The flexible barbell of claim 15 having a stiffness of at least 30,000 lbs-in$^2$ to no more than 350,000 lbs-in$^2$.

17. The flexible barbell of claim 1 wherein said weights are at least 5 lbs to no more than 500 lbs.

18. The flexible barbell of claim 17 wherein said elongated shape bends in a static mode when supported in the center of the elongated shape to the extent that said ends deflect at least 2.5 inches to no more than a 45 degree acute angle relative from said tangent to said center.

19. The flexible barbell of claim 18 wherein said elongated shape bends to the extent that said ends are at least 3 inches from said tangent to said center.

20. The flexible barbell of claim 19 wherein said elongated shape bends to the extent that said ends are at least 5 inches from said tangent to said center.

21. The flexible barbell of claim 1 wherein said elongated shape comprises a fiber reinforced resin.

22. The flexible barbell of claim 21 wherein said resin is selected from the group consisting of vinyl ester thermoset, isophthalic polyester thermoset, epoxy thermoset, polyurethane thermoset, polyvinyl chloride, polypropylene, high density polyethylene, thermoplastic rubber, and chlorinated polyvinyl chloride.

23. The flexible barbell of claim 1 further comprising a collar.

24. The flexible barbell of claim 1 further comprising a surface treatment on at least a portion of said elongated shape.

25. The flexible barbell of claim 24 wherein said surface treatment is selected from an applied coating and a wrap.

26. The flexible barbell of claim 25 wherein said wrap comprises a tape.

27. The flexible barbell of claim 25 wherein said applied coating comprises a polymeric material.

28. The flexible barbell of claim 27 wherein said applied coating has a flexural modulus of at least 15,000 psi.

29. The flexible barbell of claim 27 wherein said polymeric material has a thickness of at least 15 mils to no more than 250 mils.

30. The flexible barbell of claim 29 wherein said polymeric material has a thickness no more than 90 mils.

31. The flexible barbell of claim 1 wherein said weights are selected from the group consisting of: disc weights, weighted bags, kettlebells and chains.

32. The flexible barbell of claim 1 wherein said flexible bar is rectangular.

33. The flexible barbell of claim 1 further comprising at least one flexible rod.

34. The flexible barbell of claim 33 wherein said flexible rod is round.

35. The flexible barbell of claim 1 wherein said elongated shape has a hollow cavity which extends the entire length of said flexible bar.

36. The flexible barbell of claim 1 wherein said flexible bar comprise a fiber reinforced resin.

37. The flexible barbell of claim 36 wherein said flexible bar comprises fiberglass.

38. The flexible barbell of claim 36 wherein said flexible bar comprises carbon.

39. The flexible barbell of claim 1 comprising multiple flexible bars.

40. The flexible barbell of claim 39 comprising at least 2 to no more than 3 flexible bars.

41. The flexible barbell of claim 1 wherein said flexible bar has a flexural modulus of at least 4,000,000 to no more than 31,000,000 psi.

42. The flexible barbell of claim 1 further comprising indicia.

43. The flexible barbell of claim 1 further comprising an end closure.

44. A weight lifting system comprising said flexible barbell of claim 1.

45. The weight lifting system of claim 44 further comprising a timing device.

46. The flexible barbell of claim 1 wherein said minor axis and said major axis are not of the same dimension.

47. The flexible barbell of claim 1 wherein said hitch pin is received by said void at a distance of at least ½" to no more than 2" from an end of said ends.

48. A flexible barbell for enhancing weight lifting exercises comprising:

an elongated shape comprising a center and ends;

at least one flexible bar in said elongated shape wherein said flexible bar has a minor axis and a major axis and is capable of rotating in said elongated shape; and weights attached to said elongated shape near said ends;

wherein said elongated shape bends relative to a tangent to said center in response to said center of said elongated shape being moved;

further comprising a hitch pin wherein said hitch pin is inserted through said elongated shape at a distance of at least ½" to no more than 2" from an end of said ends.

49. The flexible barbell of claim 48 further comprising a collar.

50. The flexible barbell of claim 48 wherein said minor axis and said major axis are not of the same dimension.

51. The flexible barbell of claim 48 wherein said flexible bar is rectangular.

52. The flexible barbell of claim 48 further comprising at least one flexible rod.

53. The flexible barbell of claim 52 wherein said flexible rod is round.

* * * * *